US012220019B2

(12) United States Patent
Paulson et al.

(10) Patent No.: US 12,220,019 B2
(45) Date of Patent: Feb. 11, 2025

(54) FOOTWEAR WITH A COMPOSITE PLATE SOLE ASSEMBLY

(71) Applicant: Saucony, Inc., Waltham, MA (US)

(72) Inventors: Andrea A. Paulson, Waltham, MA (US); Christopher J. Mahoney, Concord, MA (US); Brian D. Therriault, Framingham, MA (US); Eric P. Plainte, Lexington, MA (US)

(73) Assignee: Saucony, Inc., Waltham, MA (US)

( * ) Notice: Subject to any disclaimer, the term of this patent is extended or adjusted under 35 U.S.C. 154(b) by 270 days.

(21) Appl. No.: 17/700,892

(22) Filed: Mar. 22, 2022

(65) Prior Publication Data

US 2022/0211142 A1 Jul. 7, 2022

Related U.S. Application Data

(63) Continuation-in-part of application No. 16/927,269, filed on Jul. 13, 2020, now Pat. No. 11,478,039.
(Continued)

(51) Int. Cl.
*A43B 13/12* (2006.01)
*A43B 13/14* (2006.01)

(52) U.S. Cl.
CPC ..... *A43B 13/127* (2013.01); *A43B 13/145* (2013.01)

(58) Field of Classification Search
CPC ... A43B 13/122; A43B 13/125; A43B 13/127; A43B 13/148; A43B 13/188
(Continued)

(56) References Cited

U.S. PATENT DOCUMENTS 7,096,605 B1 * 8/2006 Kozo ..... A43B 7/26 36/76 R
9,144,265 B2 * 9/2015 Lubart ..... A43B 13/20
(Continued)

FOREIGN PATENT DOCUMENTS

CN 101073451 A 11/2007
CN 101516222 A 8/2009
(Continued)

OTHER PUBLICATIONS https://www.runspeedland.com/pages/obsess-everything, downloaded Mar. 4, 2022.
Quicksilver Ampla construction (prior art).

*Primary Examiner* — Sharon M Prange
(74) *Attorney, Agent, or Firm* — Warner Norcross + Judd LLP

(57) ABSTRACT

A footwear construction includes a sole assembly including a first midsole, a second midsole, a spring plate between the first and second midsoles, and an outsole. The plate can include an upward curving, multi-radii transition portion extending from a lowermost portion to a forward most portion of the plate so as to roll a wearer's foot forward into a next stride in a gait cycle of the wearer. The plate can include a lateral arm and a medial arm in the forefoot region separated by a plate slot extending rearward from the forwardmost portion of the plate toward the lowermost portion. The medial arm can be longer than the lateral arm. The plate can have a first bending stiffness during bending in a first direction, and a second bending stiffness greater than the first bending stiffness during bending in a second direction.

10 Claims, 15 Drawing Sheets

Related U.S. Application Data

(60) Provisional application No. 62/884,301, filed on Aug. 8, 2019.

(58) Field of Classification Search
USPC ..... 36/107, 108
See application file for complete search history.

(56) References Cited

U.S. PATENT DOCUMENTS

| | | | | |
|---|---|---|---|---|
| 9,370,904 | B2 | 6/2016 | Khan | |
| 9,999,524 | B2 | 6/2018 | Clausen et al. | |
| 10,016,012 | B2 | 7/2018 | Auger et al. | |
| 10,441,027 | B2 | 10/2019 | Bartel et al. | |
| 10,448,704 | B2 | 10/2019 | Dupre et al. | |
| 10,743,607 | B2 | 8/2020 | Amis et al. | |
| 10,750,817 | B2 | 8/2020 | Barnes et al. | |
| 10,786,973 | B2 | 9/2020 | Simmons et al. | |
| 10,966,483 | B2 * | 4/2021 | Truelsen | A43B 5/06 |
| 11,109,639 | B2 | 9/2021 | Shanker et al. | |
| 2003/0069807 | A1 | 4/2003 | Lyden | |
| 2007/0068039 | A1 * | 3/2007 | Nau | A43B 3/0036 36/102 |
| 2010/0307028 | A1 * | 12/2010 | Teteriatnikov | A43B 13/145 36/108 |
| 2014/0026443 | A1 * | 1/2014 | Derrier | A43B 13/026 36/107 |
| 2017/0079373 | A1 * | 3/2017 | Huard | A43B 7/144 |
| 2017/0095033 | A1 | 4/2017 | Farina et al. | |
| 2017/0095034 | A1 | 4/2017 | Dupre et al. | |
| 2018/0092430 | A1 | 4/2018 | Auger et al. | |
| 2018/0184756 | A1 | 7/2018 | Bartel et al. | |
| 2018/0184757 | A1 | 7/2018 | Bartel et al. | |
| 2018/0289106 | A1 | 10/2018 | Bartel et al. | |
| 2019/0150562 | A1 * | 5/2019 | Bartel | A43B 13/22 |
| 2019/0357627 | A1 | 11/2019 | Shanker et al. | |
| 2019/0365033 | A1 * | 12/2019 | Chambers | A43B 13/026 |
| 2019/0373982 | A1 | 12/2019 | Dupre et al. | |
| 2020/0121021 | A1 | 4/2020 | Bartel et al. | |
| 2021/0267306 | A1 | 9/2021 | Sakaguchi et al. | |

FOREIGN PATENT DOCUMENTS

| | | | |
|---|---|---|---|
| CN | 108471833 | A | 8/2018 |
| CN | 108471834 | A | 8/2018 |
| CN | 109475200 | A | 3/2019 |
| CN | 109475201 | A | 3/2019 |
| CN | 109475202 | A | 3/2019 |
| CN | 109561747 | A | 4/2019 |
| EP | 2 048 981 | B1 | 8/2014 |
| KR | 20020076052 | | 10/2002 |
| KR | 2017/058420 | A1 | 4/2017 |
| WO | 2017/058419 | A1 | 4/2017 |

* cited by examiner 220
250
240
246V
LA
XI
XII
XIII
XIV
X 220
230
240
260
246V
260L
280
271
272
282
285
284
273
280
260F
250
16
14
12

FOOTWEAR WITH A COMPOSITE PLATE SOLE ASSEMBLY

CROSS REFERENCE TO RELATED APPLICATIONS

This application is a continuation in part of patent application Ser. No. 16/927,269 filed Jul. 13, 2020, entitled FOOTWEAR WITH A COMPOSITE PLATE SOLE ASSEMBLY, which claims priority to provisional application Ser. No. 62/884,301, filed Aug. 8, 2019 entitled FOOTWEAR WITH A COMPOSITE PLATE SOLE ASSEMBLY.

BACKGROUND OF THE INVENTION

The present invention relates to footwear, and more particularly to footwear including a sole assembly having a composite plate that cooperates with an outsole to provide enhanced stability, traction and improved energy return to a wearer.

There is a variety of different types of sole assemblies used in conjunction with footwear. Many sole assemblies include a midsole constructed from foam and an underlying outsole, usually constructed from rubber for durability. The foam provides underfoot cushion, and the outsole can include lugs for traction and wear resistance. Some sole assemblies also can include a footbed above the midsole to enhance comfort while the footwear is worn by a wearer.

Many manufacturers, particularly of running and performance footwear, modify sole assemblies to include a shank or a plate to increase or provide a custom level of stiffness to the sole assembly. A common type of plate is a composite plate that is molded into the midsole. To form such a midsole, a plate is positioned in a mold, and flowable foam is injected around the plate, which thereby becomes embedded in the midsole, with foam above and below the plate. With the plate typically fully embedded in the midsole foam, the plate is less prone to rupture or buckle under forces encountered during normal use. The encapsulating foam also can protect and cushion the plate from abrupt impact forces.

Some manufacturers modify the above type of composite plate to include a slit running rearward from the toe under the metatarsal head to the arch region. This type of slit can enhance the side to side flexibility of the plate, however, it typically is not executed well. Frequently, the slit is too narrow, and the plate to the left and right of the slit extends too far forwardly under all the toes of a wearer. As a result, the tips of the plate can become worn out and crack, and/or the slit can cause the side parts of the plate to become too flexible, and not flexing in unison, which can throw the gait of the user.

Another issue with current composite plates is that they typically are uniformly rigid. Thus, they bend the same in the upward direction as in the downward direction. For outdoor performance shoes and hiking boots having a particularly rigid composite plate, this can be problematic because it can inhibit upward bendability of the footwear during toe off when climbing a hill or other terrain. Conversely, if the plate is too bendable, it will not offer adequate support when the footwear engages rocks or hard terrain.

Accordingly, there remains room for improvement in the construction of sole assemblies including composite plates to increase flexibility, stability, and durability, yet provide focused support of the foot during certain activities.

SUMMARY OF THE INVENTION

A footwear construction includes a sole assembly including a first midsole, a second midsole, a spring plate between the first and second midsoles, and an outsole.

In one embodiment, the plate can include an upward curving, multi-radii transition portion extending from a lowermost portion to a forward most portion of the plate so as to roll a wearer's foot forward into a next stride in a gait cycle of the wearer.

In another embodiment, the plate can include a lateral arm and a medial arm in the forefoot region separated by a plate slot extending rearward from the forwardmost portion of the plate toward the lowermost portion. The medial arm can be longer than the lateral arm.

In a further embodiment, the plate can have a first bending stiffness during bending in a first direction, and a second bending stiffness greater than the first bending stiffness during bending in a second direction.

In another embodiment, the sole assembly can include a plate having an upward curving, multi-radii transition portion extending from a lowermost portion of the plate to the forward most portion of the plate. This transition portion can be configured to provide a bias so as to return energy to the wearer's foot, and thus the wearer, as the wearer's foot transitions to and through toe off during a normal gait cycle.

In still another embodiment, the multiple radii in the transition portion can include a first radius that is between 135 mm and 145 mm, and a second radius that is between 145 mm and 165 mm. Other radii can further be included. The radii can be staged so that the transition portion follows a contour of a smaller radius first, forward of the lowermost portion of the plate, then transitions to a contour of a larger radius next, more forward of the lowermost portion of the plate, as the plate transitions to a forwardmost portion of the plate. This can provide more spring and energy return to a wearer's foot upon transition to and through toe off.

In yet another embodiment, the lowermost portion of the plate can be configured to be disposed under a ball of a wearer's foot. The plate also can be exposed through openings defined by the outsole layer to visually confirm for a consumer or a wearer that the footwear includes the plate from a bottom viewing of the sole.

In even another embodiment, the first midsole platform can include a first wall that surrounds at least a portion of the plate. The first wall can include a lateral registration projection extending downward in at least one of the arch region and the forefoot region, and/or a medial registration projection extending downward in at least one of the arch region and the forefoot region.

In even a further embodiment, the plate can define an aperture extending through the plate in the forefoot region. A mounting cap can be joined with the plate and can extend through the aperture. The mounting cap can include a mounting flange that extends radially outward from a longitudinal axis of the mounting cap adjacent the aperture. The mounting cap can define a threaded bore configured to receive a spike.

In still a further embodiment, the mounting flange of the mounting cap can directly engage at least one of an upper surface and a lower surface of the plate. The mounting cap can include a barrel extending through the aperture and below the lower surface of the plate. The threaded bore can be defined in the barrel, below the lower surface of the plate.

In yet a further embodiment, the plate can define multiple apertures configured to receive multiple mounting caps for mounting multiple spikes to the plate. The apertures can be defined forward of the lowermost portion of the plate, and rearward of a forwardmost portion of the plate. Spikes joined with the footwear can all be joined to the plate.

In another embodiment, the apertures can be defined along the plate on different contours of the plate, for example along different radii of curvature of the plate forward of the lowermost portion of the plate. For example, a first aperture and a first associated mounting cap can be disposed along a first radius of curvature of the plate, and a second aperture and a second associated mounting cap can be disposed along a second radius of curvature of the plate.

In still another embodiment, the mounting cap can include a mounting flange that extends radially outward from a longitudinal axis of the cap. The mounting flange can be adhered to an upper surface of the plate. The mounting cap can include a barrel that extends downward, through an aperture defined by the plate. The barrel can also extend through the outsole layer, which can be immediately adjacent the carbon plate.

In another embodiment, the footwear can include a plate with multiple radii of curvature in a transition portion extending between a lowermost portion and a forward most portion of the plate in the forefoot region. The plate can include a lateral arm and a medial arm in the forefoot region separated by a plate slot extending rearward from the forwardmost portion of the plate toward the lowermost portion.

In still another embodiment, the plate can include a first bending stiffness during bending in a first direction and a second bending stiffness greater than the first bending stiffness during bending in a second direction. For example, the plate can include a first bending stiffness during bending in an upward direction, where the plate appears to become more concave when viewed from a side view, and a second bending stiffness greater than the first bending stiffness during bending in a downward direction, where the plate appears to become more convex when viewed from a side view. Of course, these bending stiffness characteristics can be reversed.

In yet another embodiment, the plate can be constructed with a lower layer and an upper layer. The plate can be elastically bendable about an axis in a first direction, for example, bowed slightly upward, that puts the lower layer in tension and the upper layer in compression. The plate can be elastically bendable about the axis in a second direction opposite the first direction, for example, bowed slightly downward, that puts the lower layer in compression and the upper layer in tension.

In even another embodiment, wherein the plate can include an overall length. The plate also can include a curvature defined by a tread radius, emanating from a center of a circle above the plate, and extending to a lowermost portion of the plate in the forefoot region corresponding to a metatarsophalangeal joint of a wearer's foot. That tread radius can be between 37% and 42% of the overall length.

The present footwear construction provides benefits in energy return and improved gait efficiency that previously have not been achievable. The current sole assembly, with its plate configuration, can decrease the amount of energy lost at the metatarsophalangeal joint of a wearer's foot. In turn, this can increase the amount of energy transferred to the wearer's foot before and during toe off, thereby assisting the wearer in rolling into the next stride of their gait. The sole assembly can increase the efficiency of the wearer's gait as the wearer is engaged in a running activity, which it turn can enhance the wearer's overall performance in that activity. Such performance improvements might be noticed in shorter running activities, such as sprints, as well as in longer running activities, such as marathons and other long distance runs. Where the sole assembly includes a plate defining apertures, and mounting caps that extend through the apertures, those mounting caps can quickly and rigidly be used to mount traction spikes to the sole assembly. In constructions where the plate includes different bending stiffness, the plate can be well suited to allow a user to traverse up hills, with the plate flexing upward with the user's foot. The plate also can prevent a downward bend when the footwear encounters jagged or projecting underfoot terrain, such as rocks or other elements. This in turn can provide stability and support to the user's foot upon such encounters. Where the plate is bifurcated in the forefoot, the plate can provide lateral or side to side flexibility, yet still provide longitudinal stiffness and stability.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
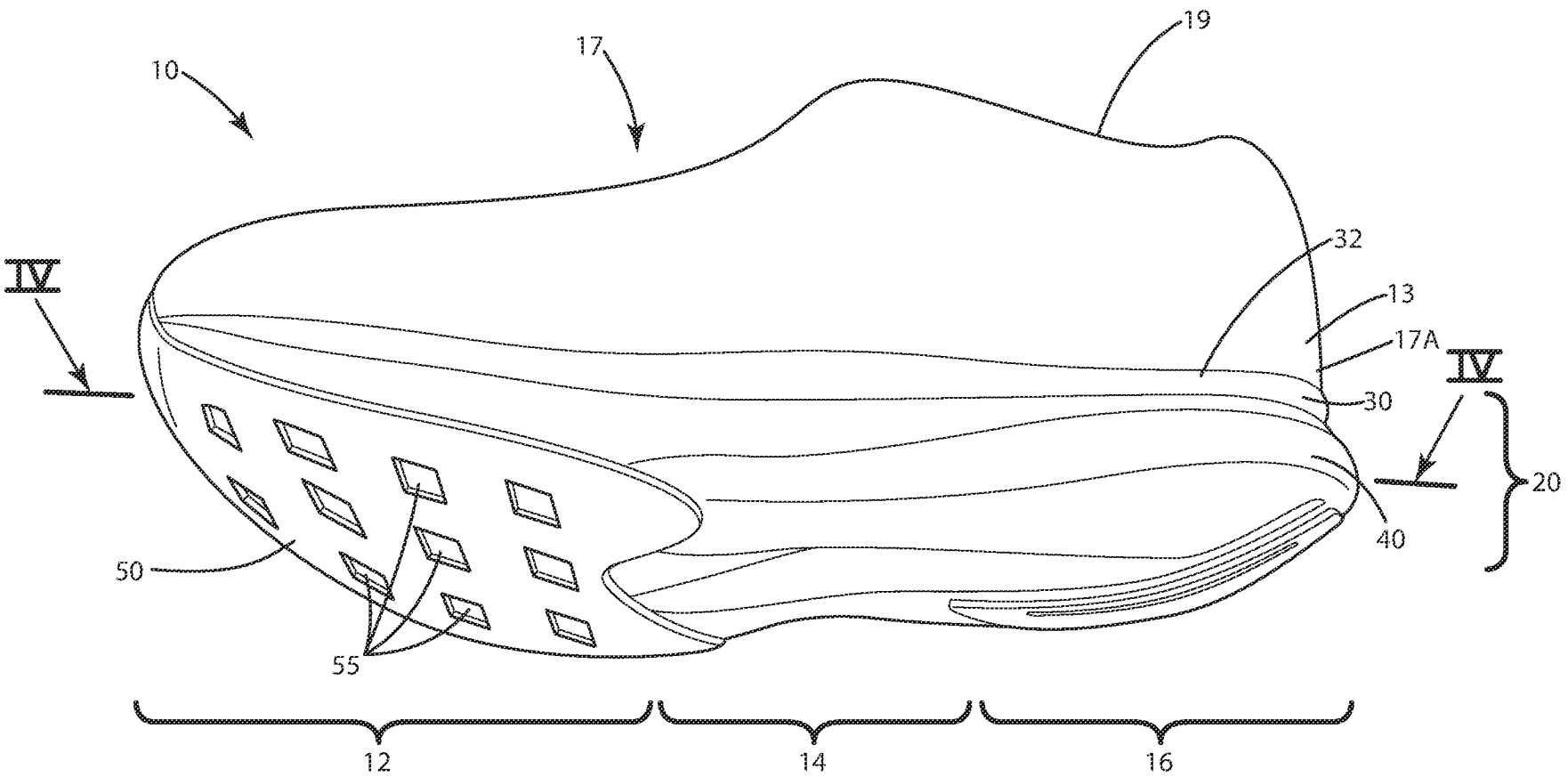
FIG. 1 is a side view of footwear of a current embodiment illustrating the sole assembly with its first and second midsole platforms.

A current embodiment of the footwear is illustrated in FIGS. 1-4 and generally designated 10. In this embodiment, the footwear includes a sole assembly 20 including a first midsole platform 30, a second midsole platform 40, a plate 60 therebetween and an outsole layer 50 having multiple treads in the forefoot region of the footwear, where the plate is directly above and engaging the outsole layer. Although the current embodiment is illustrated in the context of a running shoe, the sole assembly thereof can be incorporated into any type or style of footwear, including performance shoes, trail shoes and boots, work boots, all-terrain shoes, hiking shoes, athletic shoes, running shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe.

The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 12, arch region or mid-foot region 14, and heel region 16 generally are identified in FIG. 1; however, delineation of these regions may vary depending upon the configuration of the sole assembly and/or footwear.

Figure 2:
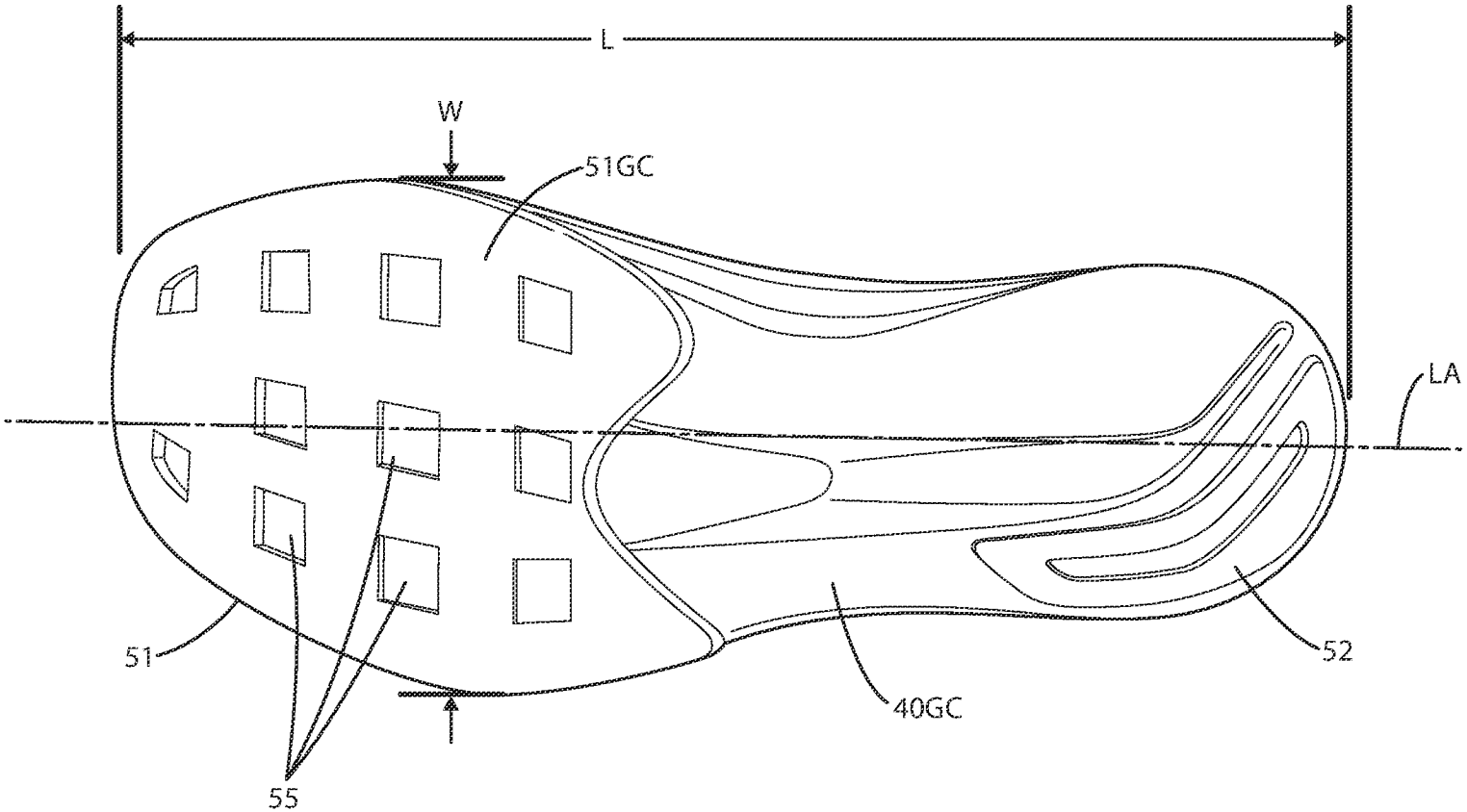
FIG. 2 is a bottom view of the sole assembly, with a portion of a composite plate exposed through the outsole and the second midsole platform.

With reference to FIGS. 1-2, the footwear 10 can include a sole assembly 20. The sole assembly 20 can include a first midsole platform 30, a second midsole platform 40, an outsole layer 50 and a spring plate 60. More or fewer elements of the sole assembly 20 can be included in some embodiments. The components of the sole assembly can individually and/or collectively provide the article of footwear 10 with a number of attributes, such as energy return, roll over, support, rigidity, flexibility, stability, cushioning, comfort, reduced weight, and/or other attributes. Generally, regardless of which components are present, the sole assembly 20 can form the bottommost portion of the footwear 10. The sole assembly 20 can include a side-to-side width W, a heel-to-toe longitudinal length L and a longitudinal axis LA, which can be shared with the footwear, sole assembly, first and second midsole platforms, plate and/or the outsole.

The footwear 10 can include a textile upper 17 joined with the sole assembly 20. The upper 17 can be formed from a variety of material elements joined together to cover at least a portion of the wearer's foot. The material elements can be selected based on the intended uses of the article of footwear 10, and can include synthetic textiles, mesh textiles, polymers or leather, for example. The upper 17 can be constructed to improve the rigidity of the sole assembly 20. For example, the upper can be constructed from leather, plastic, canvas or other materials. The upper 17 can include one or more closure elements, including for example shoelaces (not shown). The upper 17 additionally includes an upper opening 19 for receiving the wearer's foot and a lower periphery 13 for attachment to the sole assembly 20.

A footbed (not shown) can be positioned within the void defined by the upper and can be non-stretchable and lightweight and joined to the upper to provide a void for receipt of the wearer's foot. The footbed can be constructed from a sheet of material, such as foam, EVA, PU, latex, gel or other materials, and by virtue of its compressibility, provide cushioning, and may also conform to the foot in order to provide comfort, support, and stability. The lower peripheral allowance or edge of the upper can be stitched, cemented, or otherwise fastened to the footbed around the perimeter of the footbed. The sole assembly 20 can be combined with any other type or style of upper construction capable of being suitably joined with it, for example, a Strobel construction. The joining of the sole assembly/outsole and the upper can be accomplished using adhesives, cement, injection molding, pour molding or any other technique used to join an upper and sole assembly.

With reference to FIGS. 1-5, the sole assembly 20 components will now be described in further detail. As mentioned above, the sole assembly 20 can include an outsole layer 50, as well as one or more midsole platforms, for example, a first midsole platform 30 and a second midsole platform 40 disposed between the upper 17 and the outsole layer 50. A spring plate 60 as described below can be disposed between the first and second midsole platforms.

The first midsole platform 30 can include a first upper surface 31 that can be in the shape of the upper and is configured to outline a wearer's foot. The first upper surface 31 can be bounded at least partially by first upstanding midsole wall 32. This first upstanding midsole wall 32 can extend from the toe to the heel, becoming generally greater in height H1 as it extends toward the heel region. In the heel region, the wall 32 can form a heel cup to add stability to the upper 17 and a wearer's heel when positioned in the upper. The first upstanding midsole wall 32 can extend upwardly adjacent a lower peripheral allowance 17A of the upper 17, at least partially concealing that lower peripheral allowance 17A or lower portion of the upper 17. The upstanding midsole wall 32 can approximate a shape of a wearer's foot.

The first midsole platform 30 can include a first midsole platform lower surface 33 disposed opposite the first midsole platform upper surface 31 of the first midsole platform 30. This first midsole platform lower surface 33 can be substantially flat and/or planar across a majority of the width W of the sole assembly, with the exception of a plate recess 33R defined in that first midsole platform lower surface 33. The plate recess 33R can extend through the heel region 16, the arch region 14 as well as the forefoot region 12. Thus, this recess 33R can be a full length recess, extending from the heel to the toe of the footwear 10. The plate recess 33R can be bounded by a first wall 33W. This first wall 33W can transition to the plate recess 33R, dropping down into the bottom 33B of the plate recess 33R at the plate perimeter wall 33W. This plate perimeter wall 33N, as well as the first wall 33W can surround and/or circumferentiate the plate recess 33R and thus the plate 60 when placed in the plate recess 33R. The first wall 33W can include a first wall lower surface that is generally coextensive with and forms a portion of the first midsole platform lower surface 33.

The first wall 33W of the first midsole platform 30 can include one or more registration projections, such as a first registration projection 36A and a second registration projection 36B which are disposed on opposing sides of the plate recess 33R. For example, the first registration projection can be on the medial side and referred to as the medial registration projection. The second registration projection 36B can be on the lateral side of the footwear and referred to as the lateral projection registration. Again, both of these registrations can be associated with the first wall. Of course, where the first wall 33W is not present, these registration projections can be in the form of other projections that simply extend from the lower surface 33 of the first midsole platform 30. In other cases, these registration projections can be in the form of pins or posts that project from the lower surface. These registration projections can be configured to register and align the second midsole platform 40 with the first midsole platform 30 so that these elements can be joined with one another as described below, and can sandwich the spring plate 60 therebetween.

Optionally, the registration projections can be positioned in the forefoot 12 and/or arch 14 regions of the footwear 10 so as to maintain the forwardmost positioning of the second midsole platform 40 relative to the plate 60 and/or the first midsole platform 30. These registration projections do not extend into the heel region 16, and may be contained substantially entirely within the forefoot region and/or the arch region in some applications. Furthermore, these first and second registration projections optionally can be positioned adjacent the lowermost portion of the plate 60L, and can be generally closer to the heel region than that lowermost portion of the plate. In some cases, the registration projections can be in the form of a short shoulder or ramp that transitions from a first level or surface 33W1 of the first wall 33W to a second level or surface 33W2 of the first wall. The second surface 33W2 can be lower than the first surface 33W1.

The first midsole platform 30 and second midsole platform 40 optionally can be constructed from ethyl vinyl acetate (EVA), polyurethane (PU), latex, foam, a gel or other materials. As shown, the midsole platforms can be constructed from EVA to provide cushion and impact absorption.

Turning now to the second midsole platform 40, that component can include a second midsole platform upper surface 41 and a second midsole platform lower surface 43 opposite the second midsole platform upper surface. The second midsole platform can extend through the heel region than the arch region, and can terminate in at least one of the arch region 14 and the forefoot region 12. The second midsole platform 40 can include heel portion 40H and a forward portion 40F. The heel portion 40H can be configured to cover the plate recess 33R when the first and second midsole platforms are joined with one another as described below. The forward portion 40F can be forked, as illustrated and can include a lateral arm 46B and a medial arm 46A.

The lateral arm 46B and the medial arm 46A can be separated by a void 46V. This void 46V can be disposed in the arch region and/or the forefoot region, without extending to the heel portion 40H of the second midsole platform 40. The lateral arm 46B can terminate at a forward lateral edge 46BE and the medial arm 46A can terminate at a forward medial edge 46AE. When the second midsole platform 40 is joined with the first midsole, the forward lateral edge 46BE can be placed adjacent and can directly engage the lateral registration projection 36B. Likewise, the forward medial edge 46AE can be adjacent and can directly engage the medial registration projection 36A. The interaction of and engagement between the arms or other portions of the second midsole platform with the respective registration projections of the first midsole platform can precisely space and/or align the second midsole platform 40 with the first midsole platform 30, as well as with the spring plate 60. The surface 33W1 of the first wall 33W also can be precisely aligned with a perimeter 41W of the second midsole platform 40 so that the second midsole platform 40 can be joined directly to and engage that first wall 33W and its surfaces.

The arms 46A and 46B of the second midsole platform 40 can be configured so that they overlap the first wall 33W on both lateral and medial sides of the sole assembly 20 in the forefoot and/or arch region. In addition, these arms can be configured to extend over a portion of the lower surface 63 of the plate 60 in these regions, adjacent the first wall 33W. Thus, while the front edges of the arms can engage the registration projections, portions of those arms closer to the longitudinal axis LA of the sole assembly 20 can also extend over and can be joined with the lower surface 63 of the plate 60. In other words, those arms can be joined both with the first midsole platform along the first wall, as well as the bottom of the plate inward from the first wall.

Figure 3:
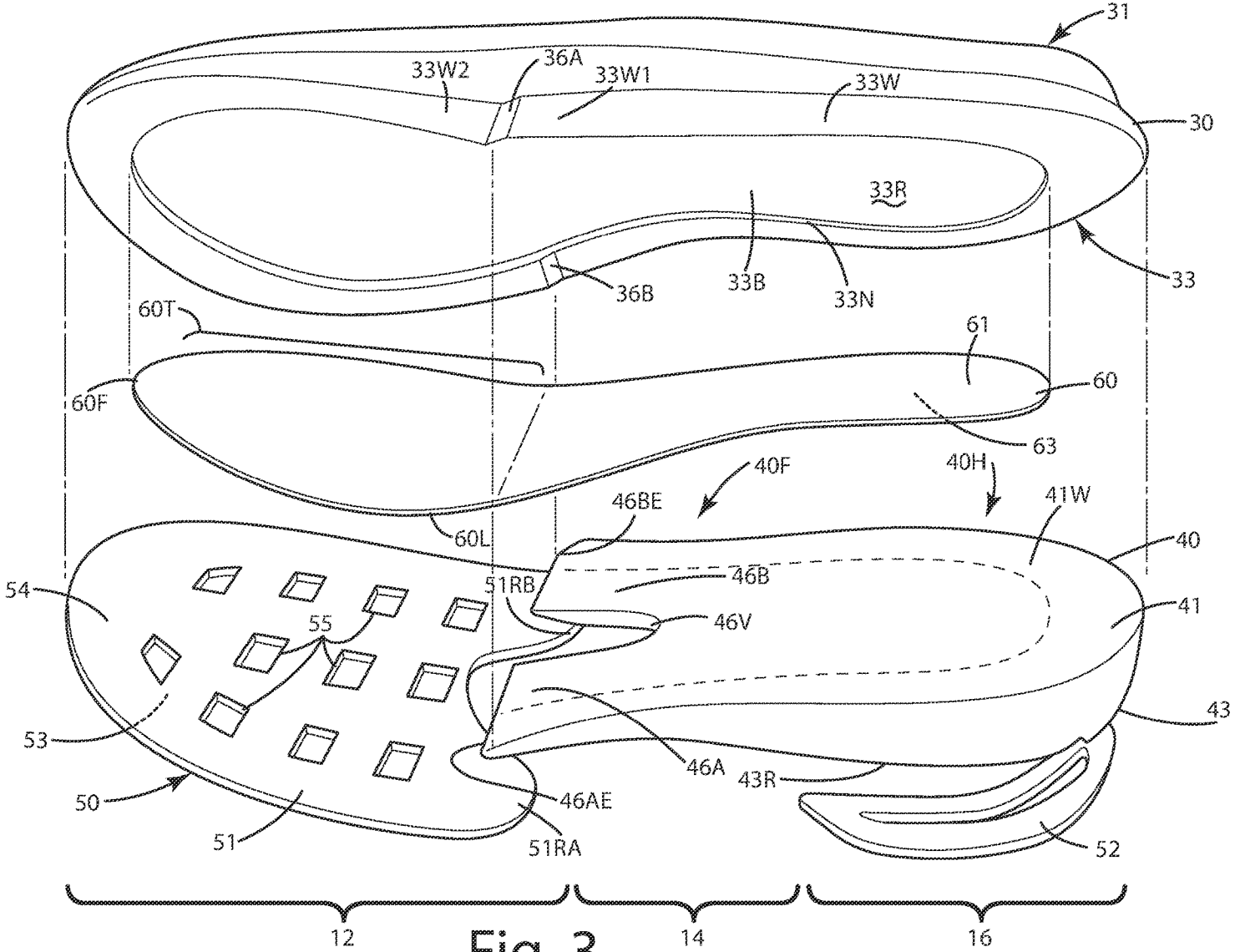
FIG. 3 is an exploded view of the sole assembly, showing the first midsole platform, the second midsole platform and the composite plate therebetween.
Figure 5:
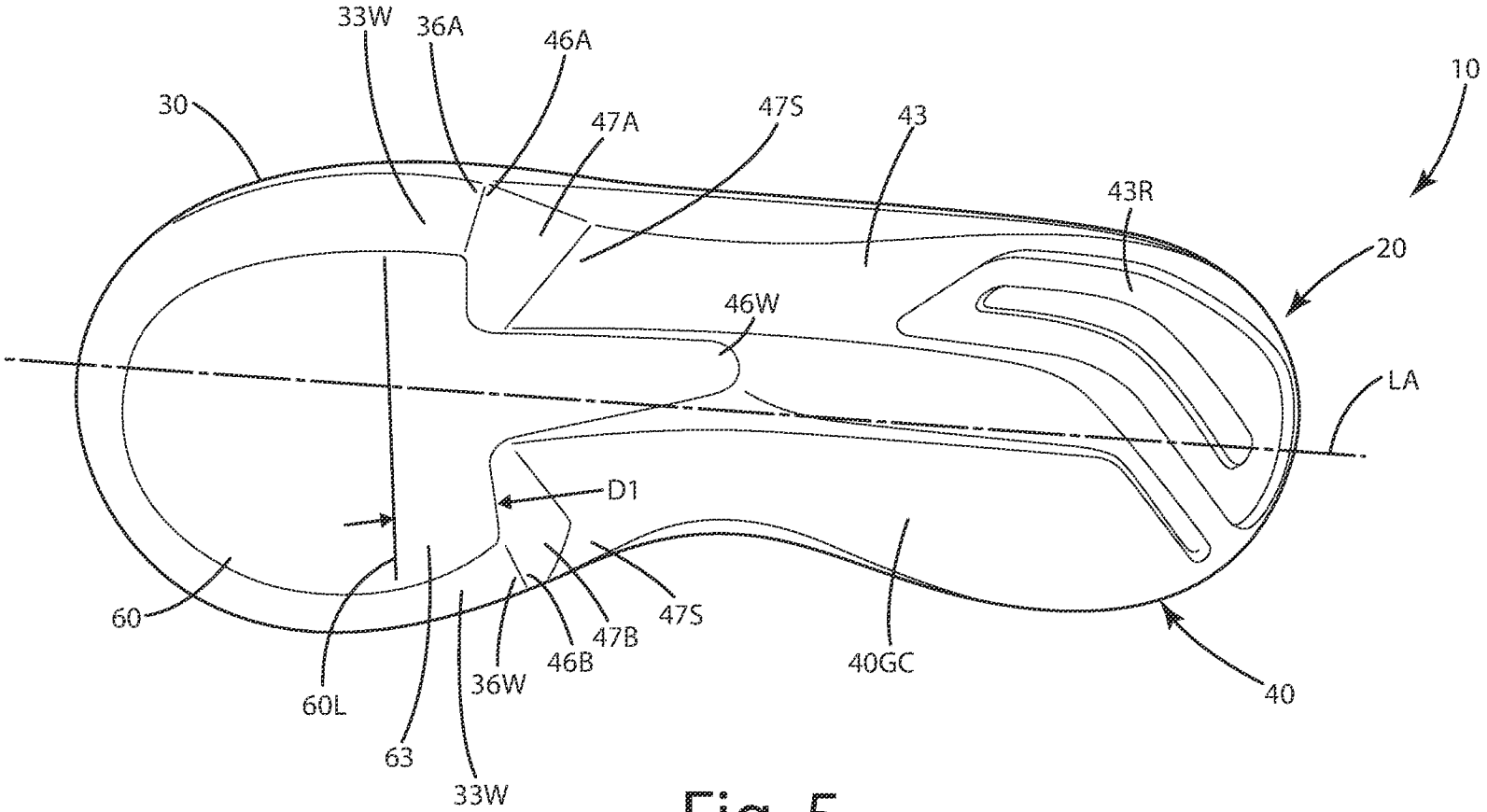
FIG. 5 is a bottom view of the sole assembly without an outsole layer, with the composite plate exposed under the first midsole platform, forward of the second midsole platform in the forefoot region.

The second midsole platform 40 as mentioned above can include a lower surface 43. As shown in FIGS. 3 and 5, this lower surface can form a ground contacting surface 40GC. This ground contacting surface can include treads or lugs. The second midsole platform lower surface can define outsole engagement recesses 47A and 47B on the respective arms 46A and 46B of the second midsole platform 40. The second midsole platform lower surface 43 can also define a rearward recess 43R that can be configured to receive a secondary outsole layer 52 of the outsole layer 50, in addition to the primary outsole layer 51. This secondary outsole layer 52 can be in the form of a heel strike layer, constructed from the same material as the outsole layer 51 in the forefoot region. This heel strike layer can be disposed generally in the heel strike region of the footwear and in at least a portion of the rearward recess 43R defined by the second midsole platform 40. This heel strike layer or secondary outsole layer 52 can be configured such that it can engage the ground surface along with the ground contacting surface 40GC of the second midsole platform 40 as well as the ground contacting surface 51GC of the outsole layer 51 in the forefoot. As mentioned below, the heel strike layer of the outsole layer can be constructed from the same material.

Optionally, the second midsole platform lower surface 43 can be constructed so that the ground contacting surface 40GC is open to the environment, while the outsole layer recesses 47A and 47B are primarily concealed by rearward edges 51RA and 51RB respectively of the outsole layer 50. These rearward edges can directly engage shoulders 47S of each of the respective recesses 47A and 47B so as to register and align the outsole layer 50 with the second midsole platform 40 as well as the plate 60 and the first midsole platform 30 in the forefoot and/or arch region. The outsole layer can conceal the transition between the second midsole platform lower surface 43 and its recesses 47A and 47B, to the lower surface 63 of the plate 60 as described below.

Optionally, the second midsole platform 40 also can define a void 46V between the arms 46A and 46B. This void 46V can extend from the forefoot region into the arch region. This void can expose a portion of the plate 60, and in particular, the lower surface 63 of the plate. Of course, this void can be absent, and the arms can be joined with one another as a single forward portion of the second midsole platform.

As mentioned above, the sole assembly 20 can include an outsole layer 50. This outsole layer 50 can include the primary outsole layer 51 in the forefoot and/or arch region, and an optional secondary outsole layer 52 in the heel region. The outsole layer 50 can directly engage and can be directly attached to the spring plate 60 in the forefoot region. The outsole layer can directly engage and be directly attached to the first midsole platform 30 in the forefoot region, and optionally the forward portion 40F of the second midsole platform 40 in the forefoot region and/or arch region. The outsole 50 can be the lowermost part of the sole assembly 20 in the forefoot region.

The outsole 50 can include multiple lugs and/or treads that extend downward, or alternatively can be relatively featureless, forming a smooth surface. Where present, the lugs and treads can be arranged as desired, and alternatively in a repeating pattern. The lugs and treads can include one or more geometric shapes. The outsole tread can be constructed from one or more materials, for example, natural or synthetic rubber, thermoplastic polyurethane elastomers (TPU), nylon, polymer blends, wear resistant polymers, elastomers and/or other materials. Other materials, such as fiber-reinforced polymers can be used, which can include epoxy, polyethylene or thermosetting plastic reinforced with carbon, glass and/or aramid fibers for enhanced protection.

The outsole 50 can include an upper surface 54 and an opposing outsole lower surface 53. The lower surface 53 can include the optional treads or lugs, and otherwise can form a ground contacting surface of the outsole 50. Optionally, the outsole layer 50 can define multiple openings 55 that extend from an outsole upper surface 54 to the outsole lower surface 53. These openings 55 can be polygonal shaped recesses or openings as illustrated. Alternatively, the openings can be of other shapes, for example, circular, triangular, rectangular, ellipsoid or other geometric shapes. These openings can expose the plate 60, and in particular the plate lower surface 63, therethrough so that the plate lower surface and the plate in general is visible through the openings 55 when the consumer views the footwear from the bottom view. This can confirm for a consumer or wearer that the plate is actually present in the footwear 10.

Figure 6:
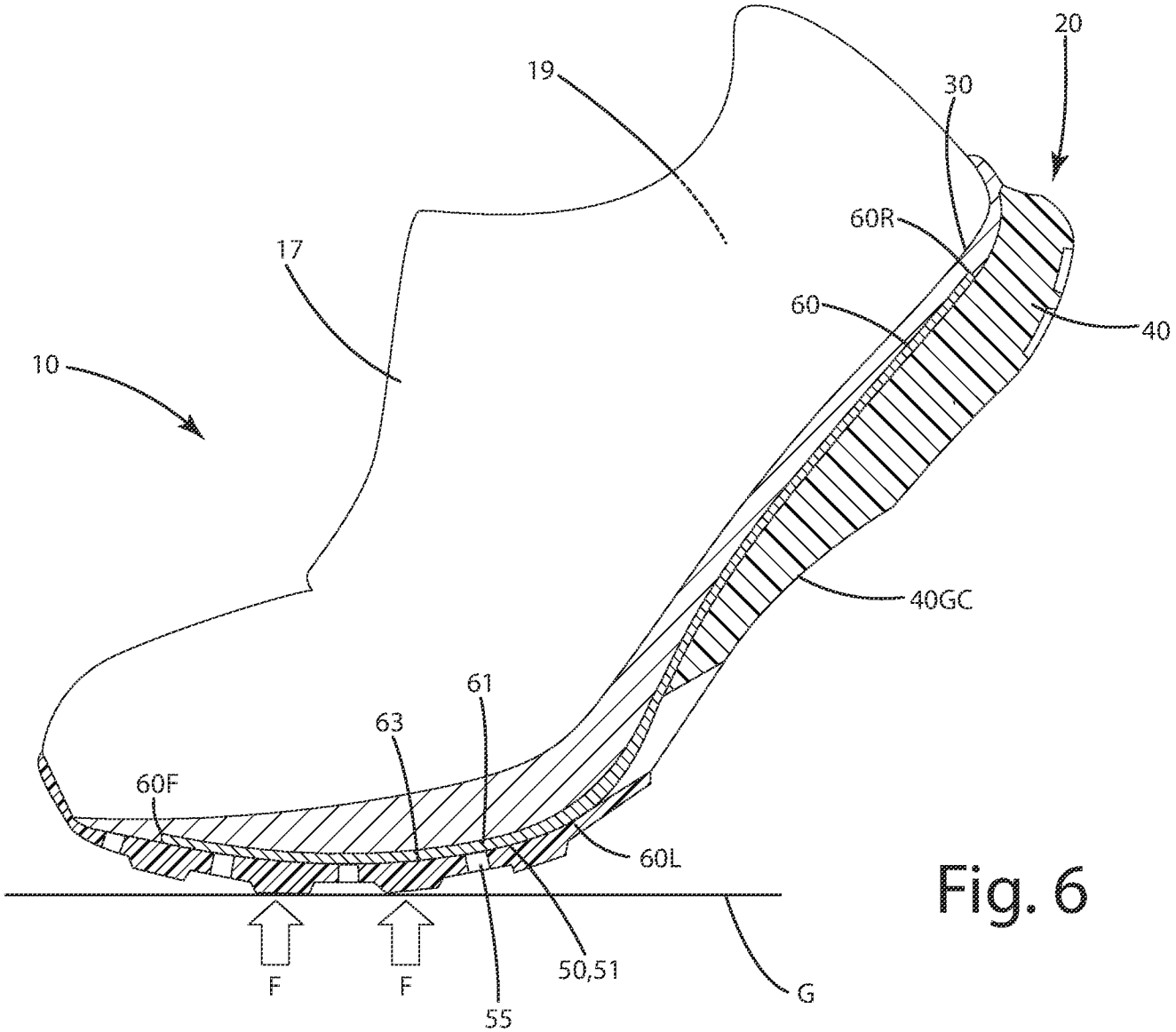
FIG. 6 is a cross section of the sole assembly of the footwear before and/or during toe off to illustrate the roll into the next stride provided by a plate of the assembly.

The outsole base can be of a substantially uniform thickness of optionally 0.5 mm to 4.0 mm, inclusive; further optionally 0.5 to 2.5 mm, inclusive; yet further optionally about 1.0 mm, under the plate 60. As shown in FIG. 6, with this thin outsole base, the outsole can be configured to directly transmit underfoot forces F through the outsole to the spring plate and likewise transmit forces from the wearer's foot to the underfoot surface to promote efficient energy return of the sole assembly.

The outsole upper surface 54 can engage directly joined with and indirectly engaging the plate 60 and in particular the plate lower surface 63. The upper surface of the outsole layer 50 also can directly engage and can be directly attached to the lower surface of the first wall 33W, in particular the surface 33W2 in the forefoot region 12. The outsole layer 50 can extend over and can be joined directly with and engage the lower surface 63 of the plate. The outsole layer 50 can terminate in the arch region and/or the forefoot region of the footwear, rearward of the lowermost portion 60L of the plate 60 such that the second midsole lower surface 43 is exposed in the arch region and/or the heel region of the footwear, between the outsole layer 50 and the heel portion 40H of the second midsole platform 40. The outsole layer 50 can be the only layer disposed under, joined with and engaging the lowermost portion 60L of the plate in the forefoot region, particularly on the lower surface 63 of the plate 60.

The outsole layer 50, as mentioned above, can be in direct contact with and directly attached to the first midsole platform 30, the plate 60 and the second midsole platform 40. Optionally, the outsole layer 50 can be directly attached to the first wall 33W of the first midsole platform 30, the lower surface 63 of the plate and in particular the lowermost portion 60L of the plate, as well as the lower surface 43 of the second midsole platform 40.

Figure 4:
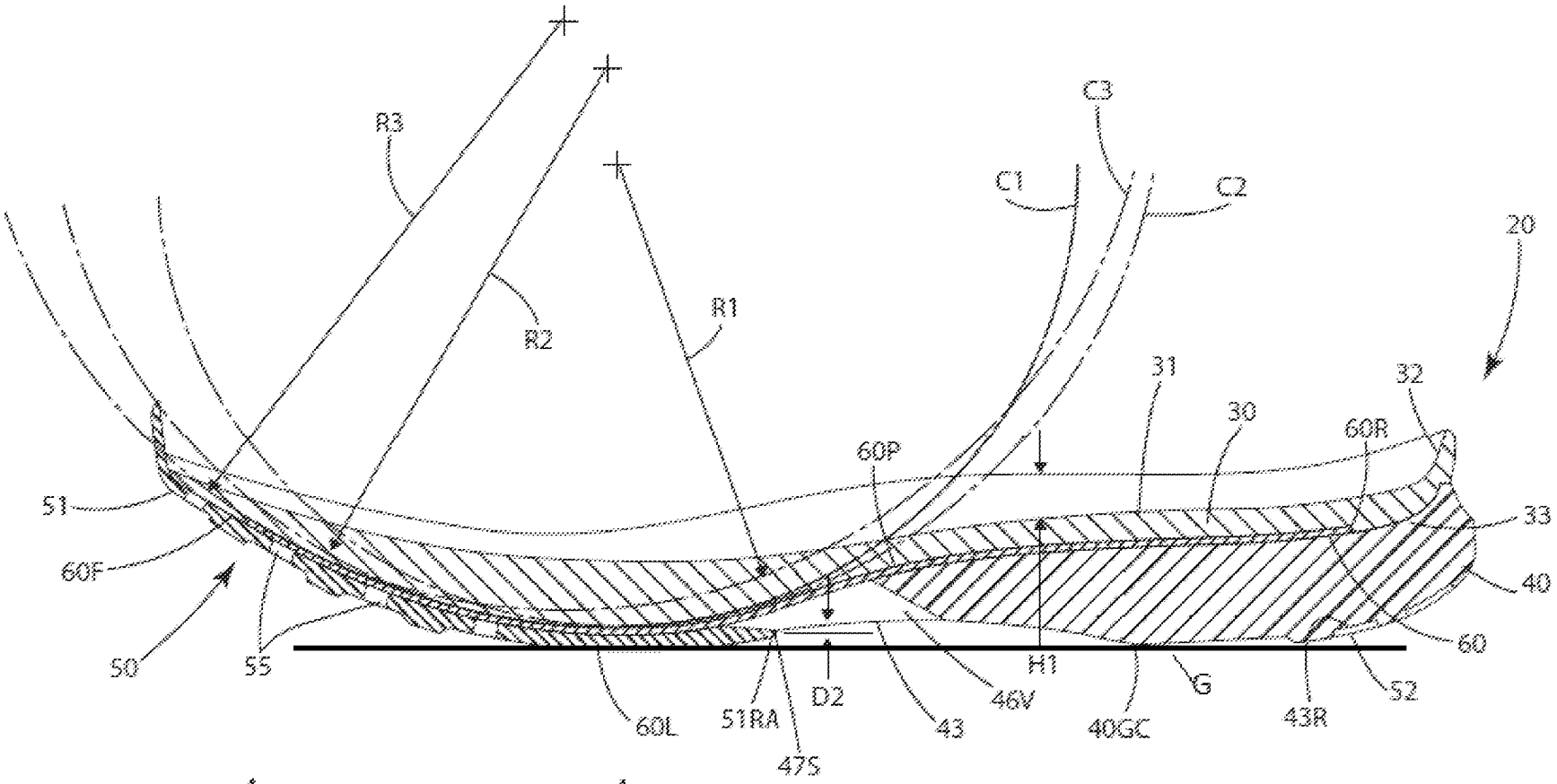
FIG. 4 is a cross section of the sole assembly of the footwear along line Iv-Iv of FIG. 1.

As shown in FIGS. 3-5, the spring plate 60 optionally can be a full length plate that extends through the forefoot region, the arch region and the heel region. This plate can extend a majority of the width W of the footwear throughout the length L of the width W. This plate can include a longitudinal axis LA dividing it into lateral and medial sides. The plate 60 can be disposed between the first midsole platform and the second midsole platform, extending through the heel region, arch region, and forefoot region of the footwear. The outsole layer can be disposed below and directly attached to or joined directly with the plate, the first midsole platform and the second midsole platform in the forefoot region.

As shown in FIG. 6 with the outsole layer 50 disposed directly below the plate 60 in the forefoot region, an underfoot force F, that engages the outsole layer, for example, during a portion of a stride of the wearer, is transmitted directly to a lowermost portion 60L of the plate. The transition portion extending from the lowermost portion 60L to the forwardmost portion 60F of the plate is configured to roll a wearer's foot forward into the next stride in a gait cycle of the wearer. This can be due to the plate storing and returning energy due to interaction of the wearer's forefoot with the ground G as explained further below.

The lowermost portion 60L of the plate 60 can directly engage and be in direct contact with the outsole layer. The forwardmost forward portion 40F of the second midsole platform 30 can terminate short of that lowermost portion 60L of the plate 60 in the forefoot region 12. The two lateral and medial arms, where included, can thus terminate short of the lowermost portion 60L of the plate in the forefoot region. In turn, the second midsole platform and its components are not disposed below the lowermost portion of the plate in the forefoot region. It is surmised that due to the plate engaging a less compressible structure, such as the outsole layer, rather than a cushioning or softer layer, such as the second midsole platform, that the plate can absorb and transfer impact forces better and also can translate the forces stored in the plate during its flexing, downward to the ground G assisting the foot to roll into the next stride.

The lowermost portion 60L of the plate 60 can be configured to set directly under the metatarsophalangeal joint of a wearer's foot. Between the lowermost portion 60 and the forward most portion 60F of the plate, the plate can include a transition portion 60T. This transition portion 60T can include multiple radii of curvature from the lowermost portion to the forwardmost portion. As shown in FIG. 4, the radii of curvature in the transition portion can include at least three different radii, for example R1, R2 and R3. These radii can correspond to contours of the plate that themselves lay along corresponding circles C1, C2 and C3. Again, the transition portion can be contoured to include parts of those circles and thus have the particular, respective radii of curvature R1, R2, R3 or other radii. The first radius R1, which can be a midfoot radius, can correspond to the contour of the plate at the lowermost portion 60L thereof. This radius R1 can be optionally between 37 mm and 187 mm, inclusive or between 120 mm and 145 mm, inclusive. The second radius R2, which can be a forefoot radius, can correspond to the contour of the plate at the portion of the transition portion 60T that is forward of the lowermost portion 60L. This second radius R2 can be optionally between 145 mm and 165 mm, inclusive, or between 43 mm and 234 mm inclusive. The third radius R3, which can be a ball radius, can correspond to the contour of the plate at the portion of the transition portion 60T that is forward of that portion with the second radius R2 and yet rearward the forwardmost portion 60F of the plate. This third radius R3 can be optionally between 45 mm and 244 mm, inclusive or between 155 mm and 175 mm, inclusive. The above radii can vary depending on shoe size. For all the above radii, the first, smaller mm size is for Men's size 3.5, and the second larger mm size is for Men's size 15. Of course, different radii can be selected for the different portions of the contour between the lowermost portion 60L of the plate and the forwardmost portion 60F of the plate, depending on shoe size.

The plate 60 can also be curved from the lowermost portion 60L of the plate 60 to the arch portion 60P in the plate which is generally located in the arch region 14 of the footwear, rearward of the forefoot region 12. From the arch portion 60P to the rearwardmost portion 60R the plate can be substantially planar and flat. This planar and flat portion can extend from the arch region through the heel region, and can terminate under the heel of a wearer. The plate also can be configured so that the lowermost portion 60L can be disposed directly under the ball of a wearer's foot, under the metatarsophalangeal joint of the wearer's foot. The plate can curve upward in the transition portion forward of the lowermost portion to a forwardmost portion of the plate. Optionally, the lowermost portion of the plate 60L can be disposed a distance D2 below the second midsole platform lower surface 43. This distance D2 optionally can be 0.01 mm to 2.5 mm, inclusive, 0.01 mm to 1 mm, inclusive, or 0.5 mm to 1.5 mm, inclusive. In other embodiments, the second midsole platform lower surface 43 can be disposed above the lowermost portion of the plate 60L.

The plate 60 can be sized and configured to fit directly in the plate recess 33R of the first midsole platform 30 as shown in FIG. 3. The plate 60 can extend forward and rearward of the registration projections. As mentioned above, the lowermost portion 60L of the plate can be disposed forward of those projections. The plate also can be joined directly with the upper surface 54 of the outsole layer 50, as well as the upper surface 41 of the second midsole platform 43.

Optionally, the various components of the sole assembly 20 can be cemented, adhered, welded and/or molded integrally with one another. As shown, the components are adhered to one another. For example, the upper surface 61 of the plate can be adhered to the bottom 33B of the recess 33R with an adhesive. The lower surface 63 of the plate 60 can be adhered to the upper surface 41 of the second midsole platform in the arch and heel regions of the footwear with an adhesive. The lower surface 63 also can be adhered directly to the upper surface 54 of the outsole layer 51 in the forefoot region with the adhesive.

As mentioned above, and as shown in FIGS. 7 and 8, the plate 60 can be constructed from multiple layers. Optionally, the plate can be constructed from a composite material, such as layers of carbon fabric that are each weaved from carbon strands. There can be at least three different layers, for example layers 61A-61F. These layers can be oriented one above the other. These layers can alternate between being oriented with their strands and weaves at a first angle offset relative to the longitudinal axis LA of the plate, to a second, different angle offset from the longitudinal axis LA of the plate. For example, the weave of carbon strands in a first layer 61A can be offset at an angle A1 from the weave of carbon strands and a second layer 61B. The angle A1 can optionally be about 60°. The weave of carbon strands in the first layer 61A can be offset by a second angle A2 from the longitudinal axis LA of the plate 60. This angle A2 can be optionally about 25° to about 35°, or about 30°. In some cases, the carbon strands in the second layer 61B can be offset about 30° from the longitudinal axis LA. The carbon strands in the second layer also can be offset by an angle A2 of optionally about 55° to about 65°, or about 60° from the carbon strands in the first 61A and third 61C layers. This pattern can be repeated throughout the thickness of the carbon plate, with the carbon strands alternating between a first angle and a second angle offset from the longitudinal axis, from one to the next. Of course, other angles of the strands can be utilized and a different number of layers utilized as well. It also will be appreciated that the plate can be constructed from other polymer materials, such as polymers, metals, composited and combinations thereof.

A first alternative embodiment of the footwear in the sole assembly is illustrated in FIGS. 9-14 and generally designated 210. This embodiment is similar to the embodiment described above in structure function and operation, with several exceptions. For example, this embodiment can include a sole assembly 220 which can be joined with an upper such as that described above. The sole assembly 220 can include a first midsole platform 230 and a second midsole platform 240 similar to those described above in connection with the current embodiment. The sole assembly 220 also can include a spring plate 260 which optionally is disposed between the first midsole platform 230 and the second midsole platform 240 in the heel region 16, generally between these elements in the arch region 14 and between the first midsole platform 230 and the outsole layer 250 in the forefoot region 12. Each of the respective first midsole platform, a second midsole platform and plate can be substantially similar to that of corresponding elements in the embodiment above and therefore will not be described again in detail here.

Figure 10:
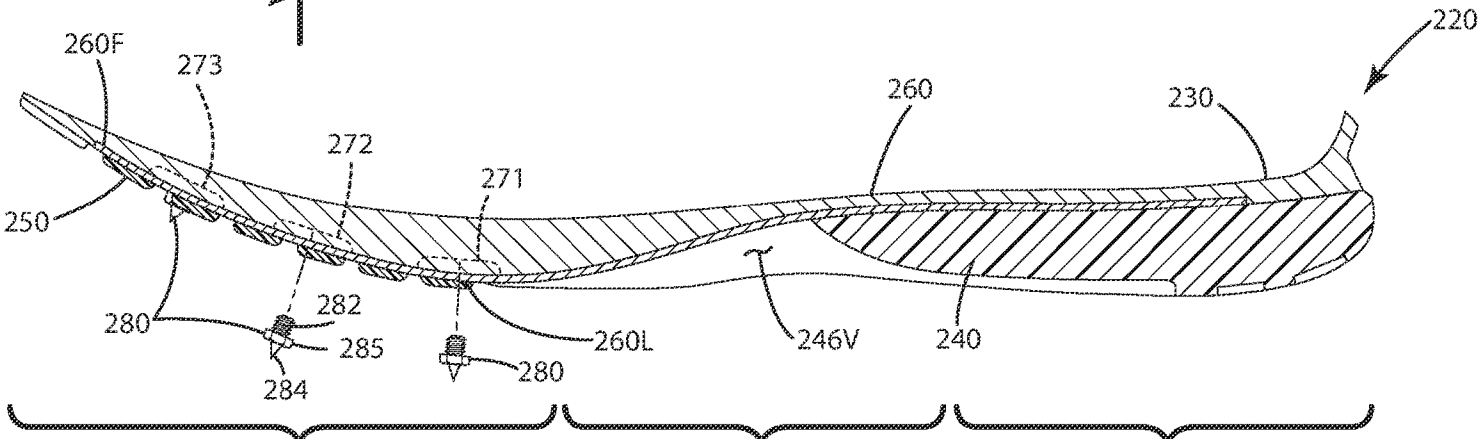
FIG. 10 is a section view of the sole assembly thereof taken along line X-X in FIG. 9.

This embodiment, however, can be configured to receive one or more traction spikes 280 as shown in FIG. 10. Such traction spikes can include a threaded portion 282 and a traction portion 284. As shown, the traction portion 284 can be in the form of a conical point, or sharp or barbed projection extending from a spike flange 285 associated with the spike. The threaded portion 282 can be threaded to be received in one or more mounting caps 270 and in particular 271, 272, and 273 as described further below. Optionally, these mounting caps can be disposed in the forefoot region 13 as shown. In other embodiments, the mounting caps and associated spikes or other traction elements can be disposed in the arch region 14 and/or heel region 16. Where the plate includes contours of varying radii, for example R1, R2 and R3 in the forefoot region, between the lowermost portion 260L and the forwardmost portion 260F of the plate, different mounting caps and their associated spikes can be located in those different contoured regions. For example, a rearward mounting cap 271 can be located in the contour of the plate 260 including the first radius R1, which is described in connection with the current embodiment above. A middle mounting cap 272 can be located in the contour of the plate 260 including the second radius R2 which is described in connection with the current embodiment above. A forward mounting cap 273 can be located in the contour of the plate 260 including the radius R3, which also is described in connection with the current embodiment above.

In the first alternative embodiment, there can be a forwardmost mounting cap 273, a middle mounting cap 272 and a rearward mounting cap 271 configured to join with associated spikes. These different mounting caps can be distributed along the longitudinal axis LA of the sole assembly 220, and optionally can be distributed at the upward curving portion of the plate that is forward from the lowermost portion 260L to the forwardmost portion 260F. Of course, where there are more or fewer mounting caps and associated spikes, these mounting caps can be distributed differently in the forefoot region, or even the arch region and/or heel region.

Figure 11:
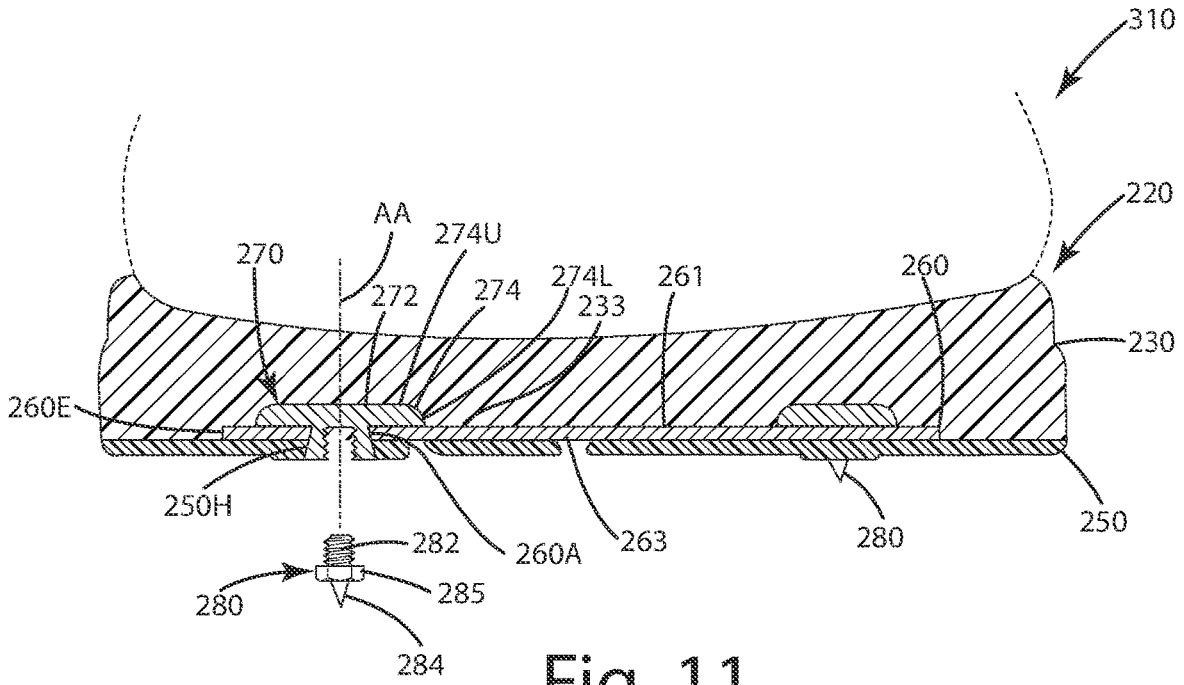
FIG. 11 is a section view of the sole assembly thereof taken along line XI-XI in FIG. 9.
Figure 12:
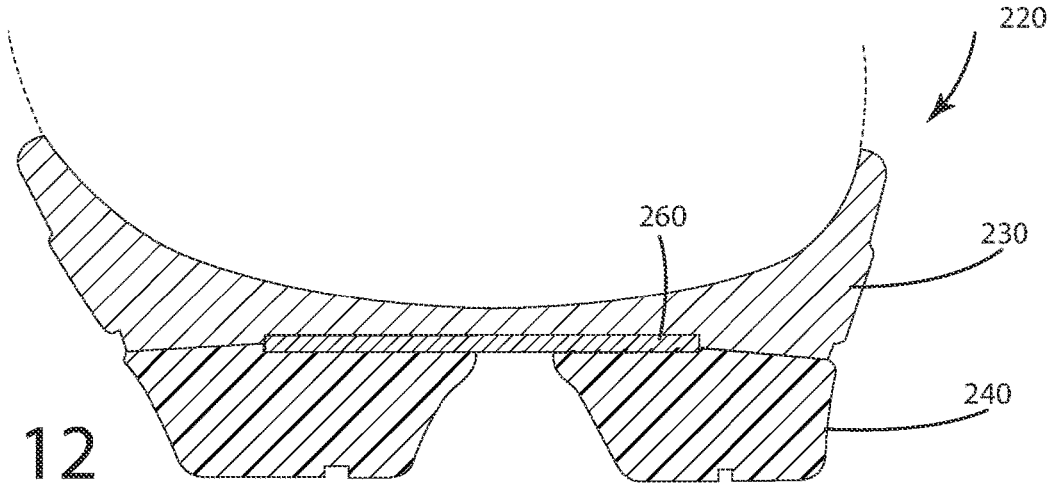
FIG. 12 is a section view of the sole assembly thereof taken along line XII-XII in FIG. 9.
Figure 13:
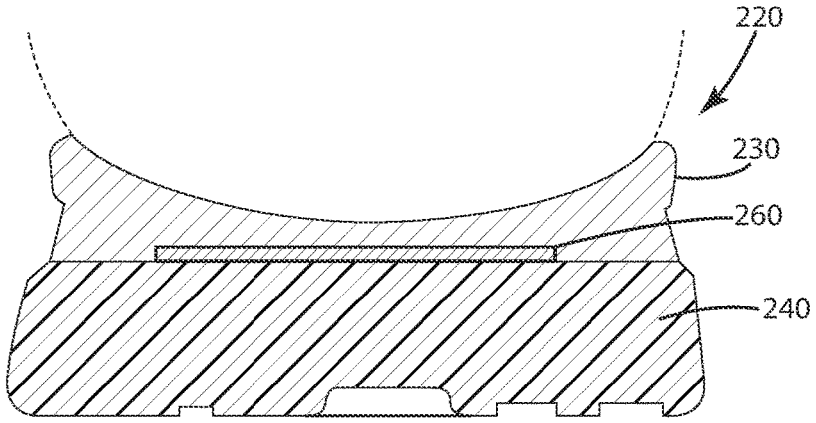
FIG. 13 is a section view of the sole assembly thereof taken along line XIII-XIII in FIG. 9.

As shown in FIG. 10, the mounting caps 270 can be joined directly with and/or directly engage the plate 260, for example in the forefoot region 13. In such a construction, as shown in FIG. 11, the plate 260 can define one or more apertures 260A. The aperture 260A can extend completely through the plate, from an upper surface 261 to a lower surface 263. The aperture 260A as shown can open to a wider dimension from the upper surface 261 to the lower surface 263. Of course in other cases, the aperture 260A can be generally cylindrical. This aperture also can be of a circular configuration as shown, however other shapes can be utilized, for example polygonal shapes, rounded shapes, elliptical shapes or other shapes. The aperture 260A also can be spaced inward from an outer edge 260E of the plate 260. Optionally, the aperture 260A can be completely bounded around an outer periphery by the material of the plate 260. The one or more apertures 260A optionally can be formed by die cutting, water jetting, punching, molding and/or drilling through the plate 260.

Generally, the upper surface 261 and the lower surface 263 adjacent the aperture 260A can be substantially planar and featureless, or can conform to the contoured variable radius of the plate in the forefoot region as described above. As illustrated for example in FIG. 11, the plate from the medial edge to the lateral edge can be substantially linear and/or planar across the upper surface and the lower surface of the plate. Of course, in other applications, the plate might undulate up and down and form portions of three-dimensional cleats in the bottom of the plate to which the mounting caps are joined, depending on the application.

Where the sole assembly 220 includes an outsole layer 250 disposed adjacent and/or adhered to the lower surface 263 of the plate 60, that outsole layer also can define a hole 250H that is aligned with the aperture 260A in the plate. This hole can be aligned with and of the same size as the aperture 260A. The hole 250H also can be centered on the aperture axis AA of the aperture 260A defined by the plate.

Figure 14:
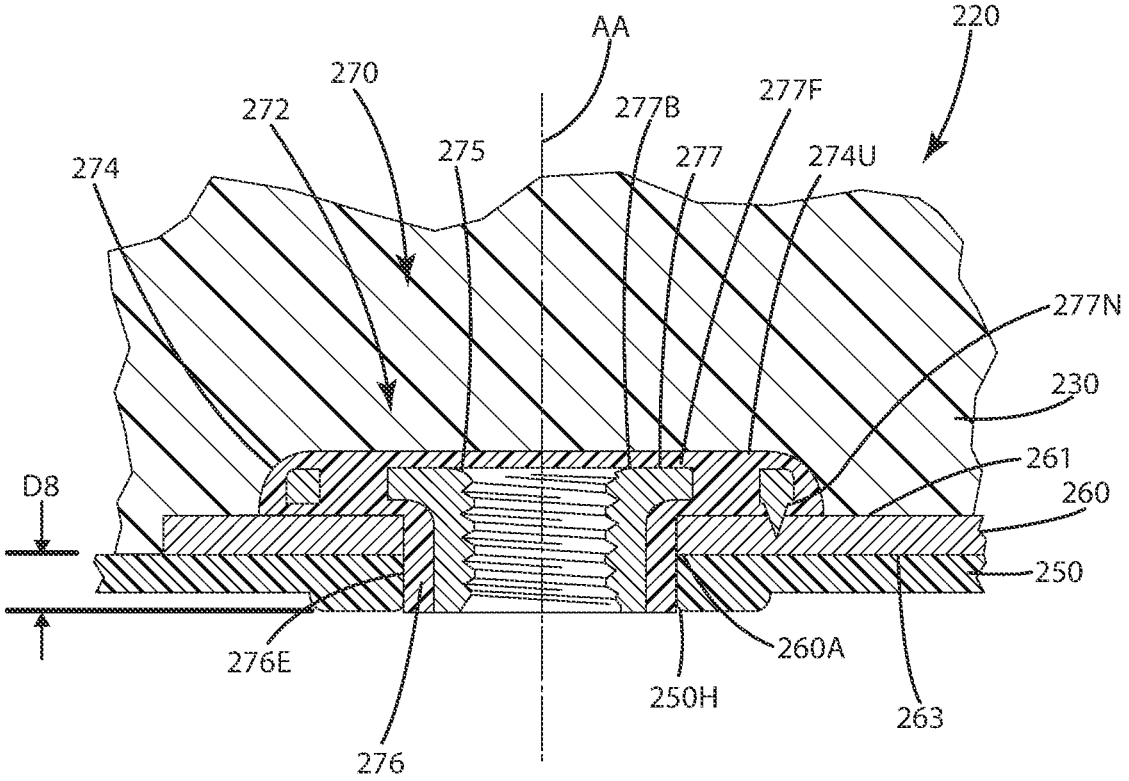
FIG. 14 is a close up section view of a mounting cap of the sole assembly taken along line XIV-XIV of FIG. 9.

FIGS. 11 and 14 illustrate the mounting cap 270, and in particular a middle mounting cap 272. Of course, the other mounting caps utilized in the sole assembly 220 of the current embodiment can be similar or identical to that cap, and all of them can be configured to receive the respective spikes 280. As shown in FIG. 14, the mounting cap 272 can be mounted generally between the first midsole platform 230 and the plate 260. As shown, the mounting cap 272 can include a mounting flange 274. This mounting flange can extend radially outward from the longitudinal axis of the mounting cap which can coincide with the aperture axis AA when the mounting cap is installed in the aperture. For purposes here, the longitudinal axis of the mounting cap and the aperture axis AA can be considered the same.

Figure 9:
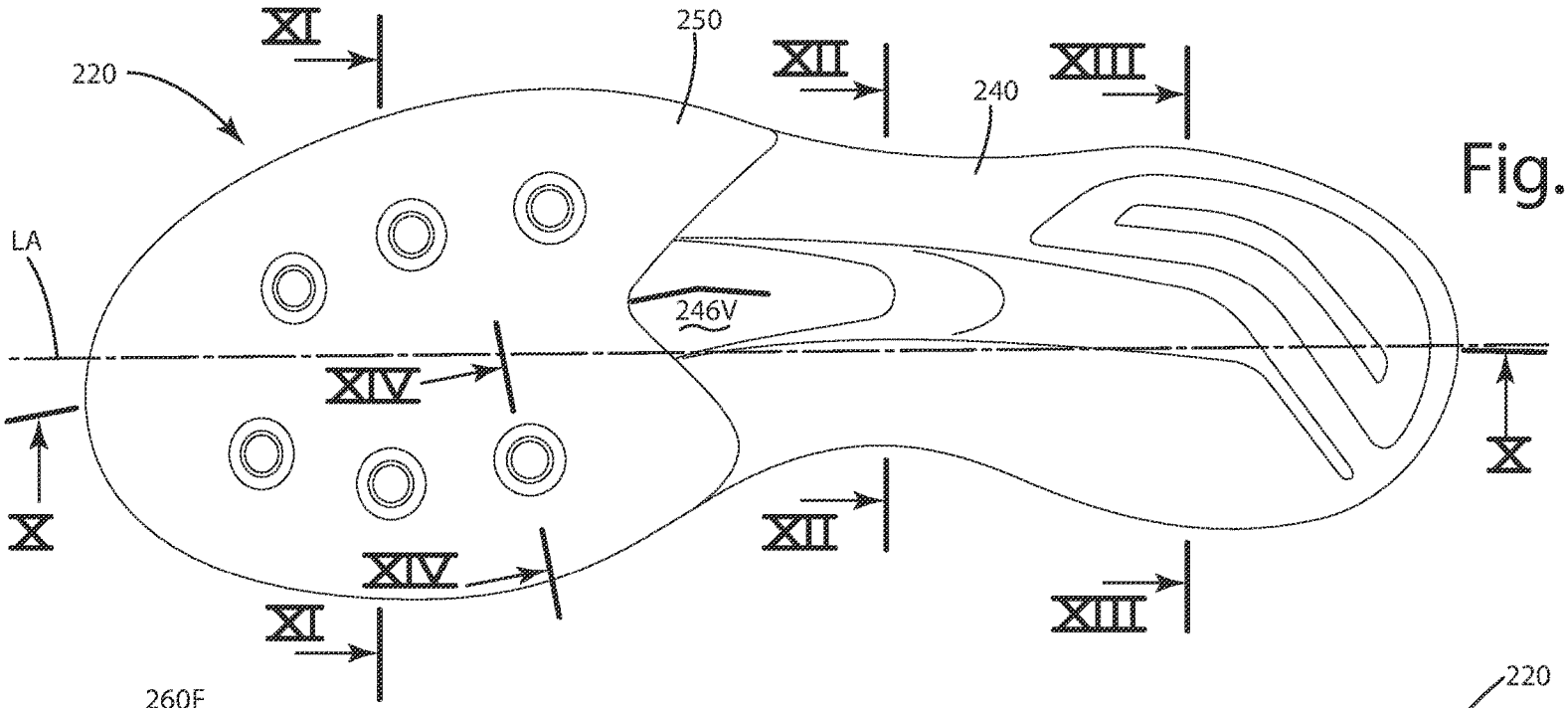
FIG. 9 is a bottom view of a second alternative embodiment of the sole assembly.

The mounting cap flange 274 can be of a generally circular configuration as shown in FIG. 9. The mounting cap flange can extend upward, away from the aperture 260A of the plate and can be of different shapes, for example, polygonal shapes, elliptical shapes, rounded shapes and the like. The mounting flange can be larger in dimension than that of the aperture 260A. The mounting flange 274 can be directly adhered to at least one of the upper surface 261 and/or the lower surface 263 of the plate. The mounting flange can include a lower surface 274L and an upper surface 274U. The mounting flange 274 can be disposed between the plate and the midsole platform 230. As mentioned above, the midsole platform 230 can be adhered, molded or otherwise engaged with the upper surface 274U of the mounting flange 274. The lower surface 274L of the mounting flange can be adhered directly to the upper surface 261 of the plate 260. Optionally, the lower surface 274L of the mounting flange can include barbs, spikes, knurls or other projections 277N that bite into and engage the upper surface or other portion of the plate such that the mounting flange does not rotate relative to the plate, for example, when a stud of the spike 280 is screwed or threaded into the mounting cap 272. Further optionally, in other embodiments, the mounting flange 274 can be a two-part mounting flange, with one part above the upper surface 261 and one part below the lower surface 263. A portion of the barrel 276 that extends from the mounting flange 274 can be threaded on an exterior surface 276 or other portion (not shown) and another washer like mounting flange can be threaded onto that barrel to clamp the plate 260 between upper and lower mounting flanges, disposed above and below the plate (not shown).

The mounting flange 274 shown in FIG. 14 can define a threaded bore 275. This threaded bore can be configured to receive a portion of a spike 280, for example a threaded portion 282 or stud of a spike as shown in FIG. 11. The threaded bore 275 can be threaded with threads corresponding to the threads on the threaded portion or stud 282 of the spike 280. The threaded bore can extend partially or completely through the plate 260. As shown, the threaded bore extends through the aperture 260A and through the hole 250H defined by the outsole layer 250. The threaded bore can extend above the upper surface 261 and below the lower surface 263. Of course, in other embodiments, the threaded bore can extend below the lower surface 263 or below the plate 260 in general. In yet other embodiments, the threaded bore can extend only through the outsole layer 250. In other cases, as shown, the threaded bore can extend above the upper surface of the plate. The threaded bore also can extend to or toward the upper surface 274U of the mounting flange 274. In some cases, it can stop short of that upper surface as shown in FIG. 14.

With further reference to FIG. 14, the threaded bore 275 can be formed in a portion of an insert 277 which is included in the mounting cap 272. The insert 277 can be rigid, optionally constructed from metal or a composite. It can include a barrel 277B which can define the threads of the threaded bore 275. The insert 277 also can include a flange 277F that extends outwardly from the axis AA. This flange 277F can form a portion of or otherwise extend into the mounting flange 274. In some cases, the insert 277 can be molded over with a polymeric material forming the remainder of the mounting cap 272, which can include the barrel 276 and the mounting flange 274 as noted above. Where the insert 277 is included, the threads 282 of the stud of the spike can engage the threads of the threaded bore 275. Optionally, the barbs or knurls 277N as described above can be formed as a portion of the flanged 277F of the insert 277. Thus, these barbs 277N can engage and bite into the plate 260 and in particular the upper surface 261 of the plate. This can impair rotation of the mounting cap 272 relative to the plate 260 when a spike is installed relative thereto.

Figure 15:
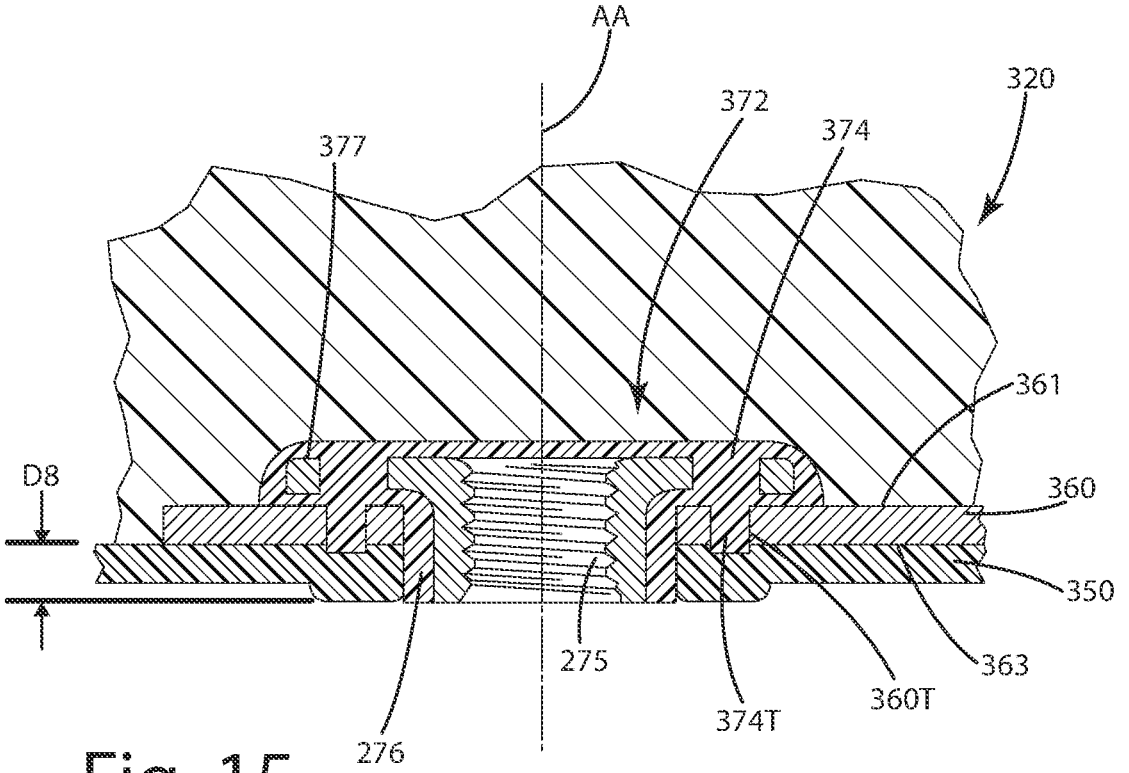
FIG. 15 is a close up section view of an alternative construction of a mounting cap of the sole assembly.

Optionally, the mounting flange can include other structures to impair or prevent rotation of the mounting cap relative to the plate when a spike is threaded into the mounting cap. As an example, shown in FIG. 15, the mounting cap 372 can include a mounting flange 374 having one or more downwardly projecting anti-rotation teeth 374T. These anti-rotation teeth 374T can be received in secondary apertures 360T that are disposed radially outward from the primary aperture 360A that is configured to receive the barrel 376 and threaded bore 375 of the mounting cap. These teeth 374T can be formed as a portion of the mounting flange 374 and separate from an insert 377. These teeth can be formed of polymeric material of the mounting cap, while the insert 377 can be constructed from a metal or composite material. Of course, in other constructions, the teeth 374 can be formed as a portion of the insert 377. In this mounting cap 372, the threaded bore 375 optionally can extend through the aperture within its barrel 376. The threaded bore 375, however, in this construction might extend only below the lower surface 363, without extending through the plate 360 and/or above the upper surface 361 of the plate 360.

Figure 8:
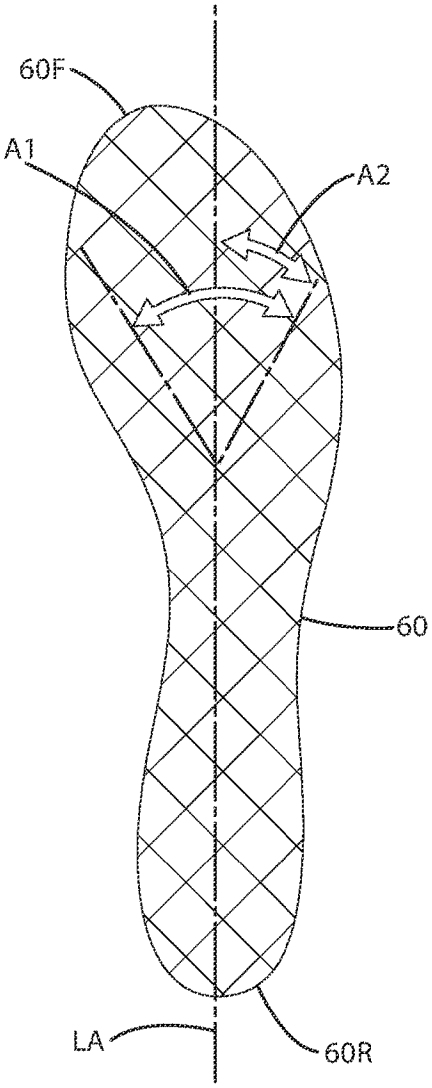
FIG. 8 is a top view of the plate illustrating the angular offset of the weaves in the different layers of carbon strands of the plate.
Figure 7:
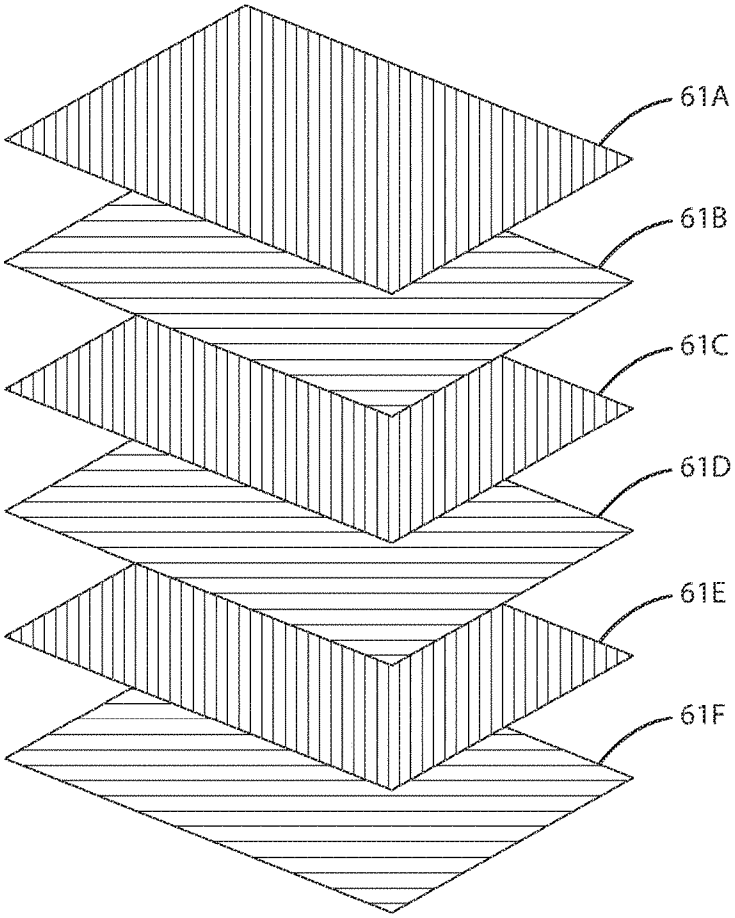
FIG. 7 is an illustration of the directional weaves of strands in different layers of carbon strands of the plate.

Returning to the embodiment shown in FIGS. 11 and 14, the mounting cap 272 can include the barrel 276. The barrel can extend through the plate 260, through the aperture in the plate, and generally from an upper surface 261 to a lower surface 263 of the plate and below the lower surface a preselected distance D8. This distance D8 can optionally be less than or equal to the thickness of the outsole layer 250 around the barrel. In other cases, this distance D8 can be greater than the thickness of the outsole layer 250 around the aperture 260A in the plate. The barrel 276 thus can extend at least partially through the outsole layer, and in some cases completely through the outsole layer. Where the plate is constructed from multiple carbon fabric layers, for example as shown in FIGS. 7-8, the aperture can extend though each of these weaved layers. Each of the layers can terminate at edges around the apertures, such that those edges bound the aperture. Thus, where a mounting cap barrel is placed through the aperture, the edges of multiple layers are adjacent the exterior of the barrel, and generally surround the barrel.

A third alternative embodiment of the footwear in the sole assembly is illustrated in FIGS. 16-21 and generally designated 320. This embodiment is similar to the embodiment described above in structure function and operation, with several exceptions. For example, this embodiment can include a sole assembly 320 which can be joined with an upper such as that described above. The sole assembly 320 can include a first midsole platform of first midsole 330 and a second midsole platform or second midsole 340 similar to those described above in connection with the current embodiment. The sole assembly 320 also can include a spring plate 360 which optionally is disposed between the first midsole 330 and the second midsole 340 in the heel region 16, arch region 14 and forefoot region 12. Each of the respective first midsole platform, second midsole platform and plate can be substantially similar to that of corresponding elements in the embodiments above.

The sole assembly of this embodiment, however, can be constructed so that the plate 360 extends between the first midsole 330 and the second midsole 340 through the heel region 16, arch region 14 and forefoot region 12. In this construction as well, the first midsole platform and second midsole platform also can be configured slightly differently than the embodiments above. For example, the first midsole 330 can include a sidewall 333W that circumferentiates a plate recess 333R. This sidewall 333W can transition to an upwardly extending wall 333U that extends from the lower surface 333 to the upper surface 331 of the first midsole 330. This first sidewall 333W can transition forward into the forefoot region 12. Near the toe region 330T, the sidewall 333W and in particular the lower surface 333 of the first midsole 330 can transition to a rearwardly extending ridge 336. This ridge 336 can be configured to fit within the spring plate slot 360S as described below. This ridge 336 can include a lateral wall 336L and an opposing medial wall 336M that extend rearward from the toe 330T to a rearward tip 336T. The rearward tip 336T can be disposed forward of the lowermost portion 360L of the plate when the plate and first midsole are joined with one another, optionally via cement, adhesive molding or other techniques. The medial wall 336M can be longer than the lateral wall 336L by optionally at least 3 mm, at least 5 mm, at least 8 mm or at least 10 mm. The portion of the recess 333RM adjacent the medial wall 336M also can extend forwardly farther then the portion of the recess 333RL adjacent the lateral wall 336L by similar distances or more. In some cases, the first midsole 330 can include a landing 337 forward of the lateral portion 333RL of the recess that is disposed adjacent the ridge 336 and the portion of the recess 333RM. This landing 337 can transition to the remainder of the lower surface 333 of the first midsole and to the sidewall 333W.

Figure 17:
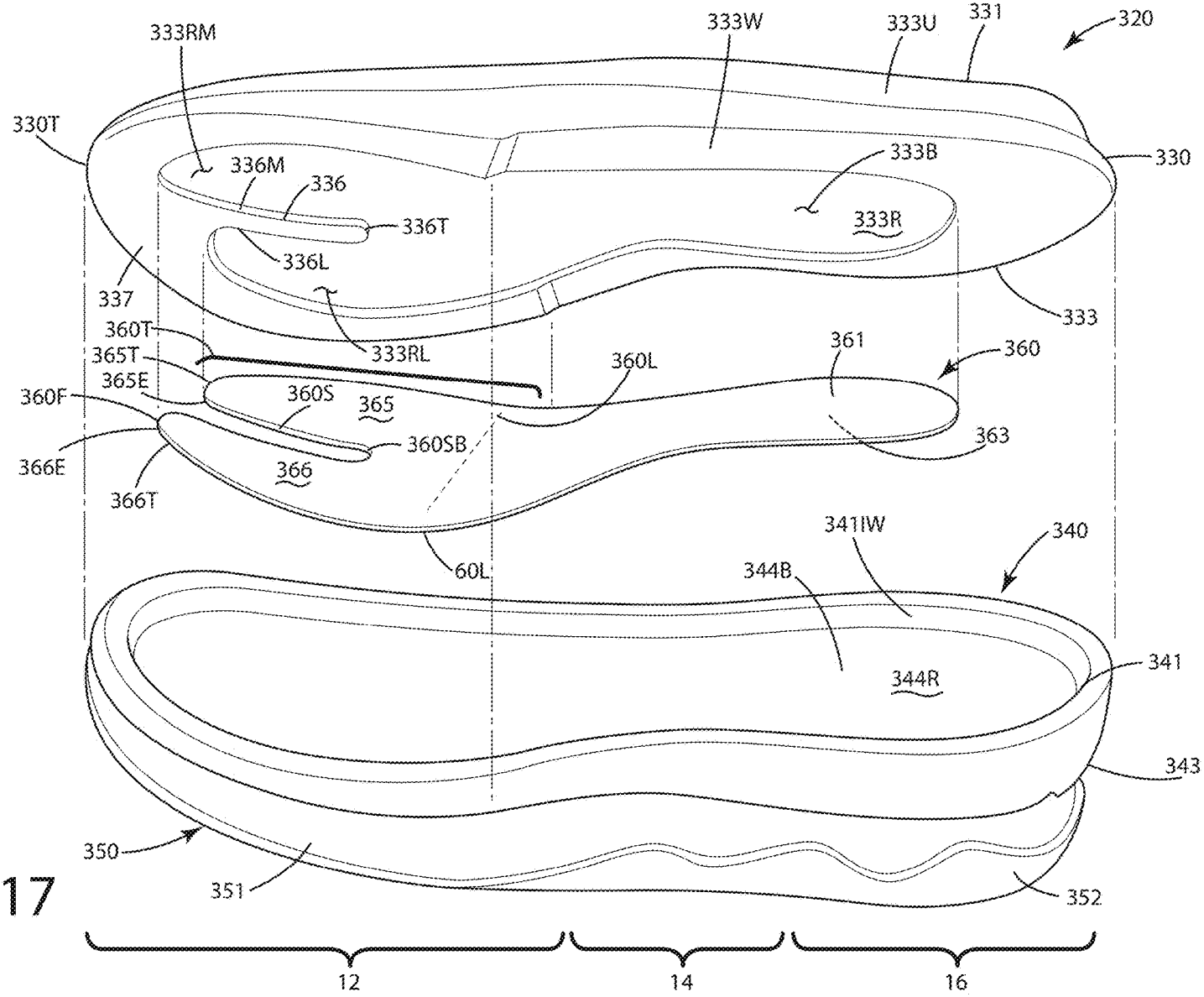
FIG. 17 is an exploded view thereof.

With reference to FIG. 17, the first midsole 330 can be configured to interfit or nest within the recess for 344R of the second midsole 340. This second midsole 340 can include a sidewall 341W that extends around the recess 344R defined by the second midsole 340 generally extending downward from the upper surface 341 toward the lower surface 343 of the second midsole 340. The recess 344R can be bounded by an inner side wall 341IW that is configured to be disposed adjacent, engage and/or be secured to the upward extending sidewall 333U of the first midsole 330 when it and the plate 360 are installed in the recess 344R. These sidewalls can be glued, cemented, adhered, molded or otherwise joined with one another to secure the first midsole within the recess of the second midsole. Further, the lower surface 333 of the first midsole 330 can be adhered within the recess 344R, for example, to the bottom wall 344B of that recess 344R. Likewise the lower surface 363 of the plate 360 can be adhered to the bottom surface 344B, while the upper surface 361 of the plate 360 can be adhered to the bottom wall 333B of the recess 333R of the first midsole 330.

Figure 19:
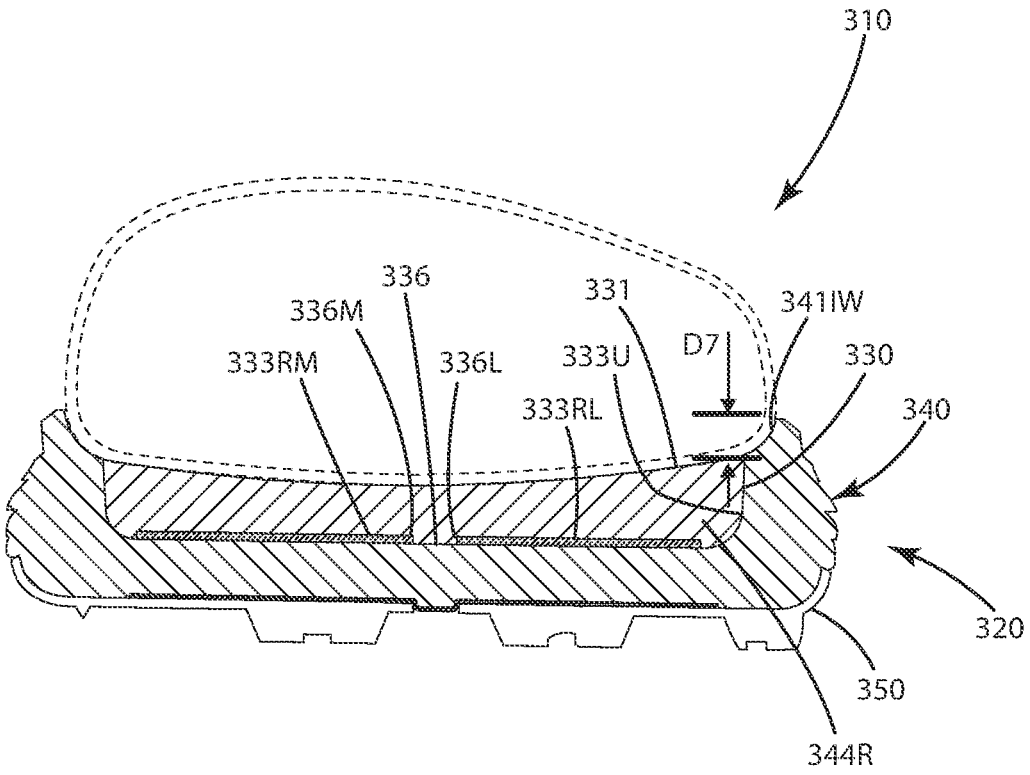
FIG. 19 is a section view thereof, taken along line XIX-XIX of FIG. 16.

As shown in FIG. 19, the sidewall 341W of the second midsole 340 optionally can be configured to extend upwardly and above the upper extending sidewall 333U of the first midsole 330. In some cases, the second midsole sidewall 341W can extend a distance D7 that is optionally at least 1 mm, at least 2 mm, at least 3 mm, at least 4 mm, at least 5 mm, at least 10 mm above the uppermost extent of the upward extending sidewall 333U of the first midsole 330. The sidewall 341W of the second midsole 340 also can extend a similar distance D7 above the upper surface 331 of the first midsole 330. In some applications, the second midsole sidewall 341W optionally can extend above and higher than the upper surface 331 of the first midsole around the entire perimeter of the first midsole.

The spring plate 360 of the sole assembly 310 of this embodiment will now be described with further reference to FIGS. 17-19. Generally, the spring plate 360 can be disposed in the first midsole lower surface 333R. When the first midsole 330 is installed in the second midsole recess 344R of the second midsole 340, the plate can be adjacent and/or secured to the bottom wall 344B of that recess 344R. The plate can be sandwiched between the first midsole 330 in the second midsole 340 throughout the forefoot region 12, the arch region 14 and heel region 16. While in the first midsole recess 333R, the lower surface 363 of the plate can be flush with the first midsole lower surface 333. The upper surface 361 of the plate 360 can engage and/or be secured to the bottom wall 333B of the recess 333R.

Figure 16:
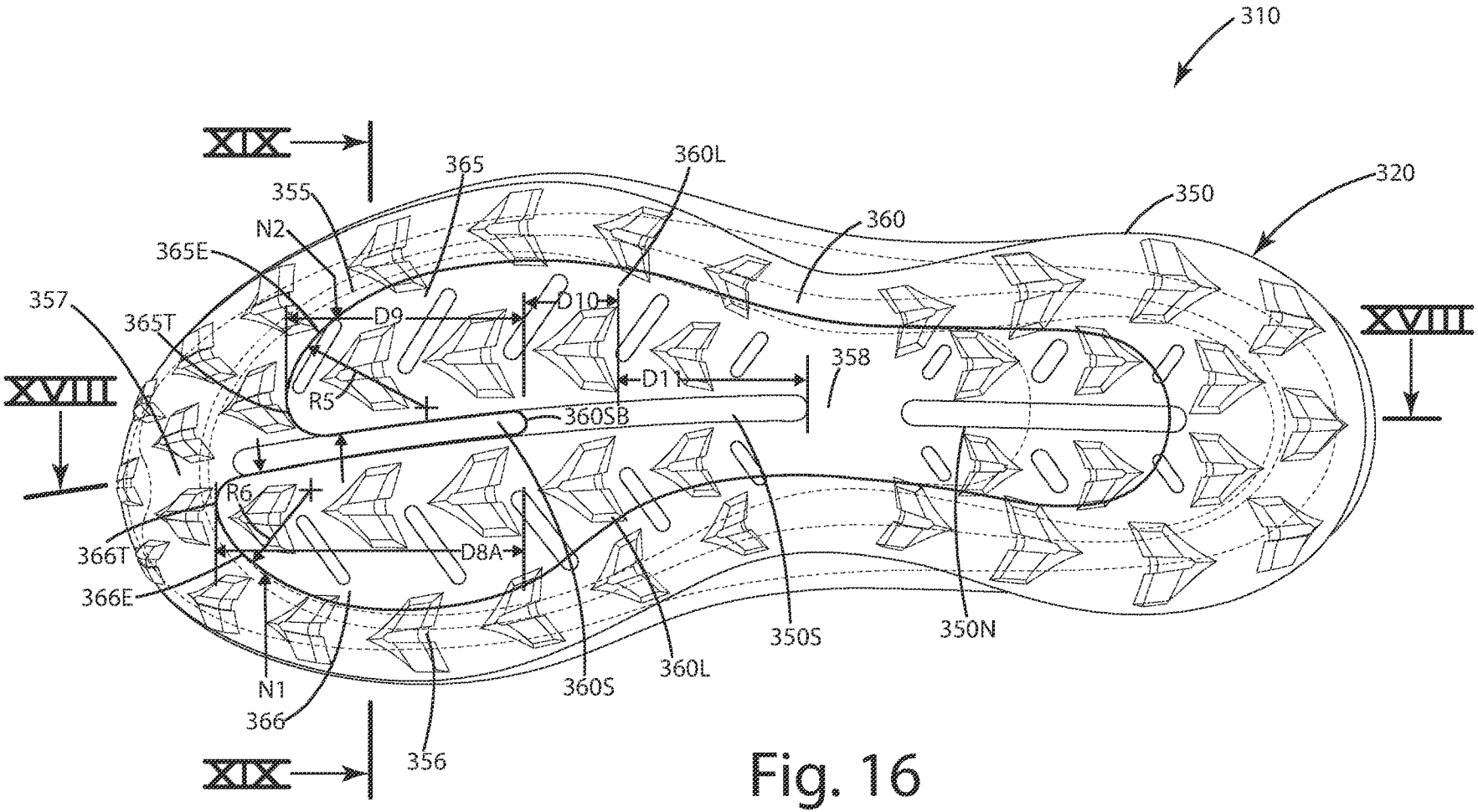
FIG. 16 is a bottom view of the third alternative embodiment of the sole assembly.

As shown in FIGS. 16, 17 and 19, the spring plate 360 can include a bifurcated forefoot portion 360T having a lateral arm 365 and a medial arm 366. The lateral arm and a medial arm can be separated from one another via a plate slot 360S. The plate slot 360S can extend rearward from the forward most portion 360F of the plate 360 toward the lowermost portion 360L of the plate which can be located in a similar location as the lowermost portion of the plates of the embodiments above and will not be described again here. The plate slot 360S can include a rounded base 360SB distal from the lowermost portion 360L of the plate. The medial arm 366 can extend a first distance D8A from the slot base 360 SB. The lateral arm 365 can extend forward a second distance D9 from the base. The first distance can be greater than the second distance, optionally at least 3 mm, at least 5 mm, at least 8 mm, at least 10 mm or at least 15 mm. The first distance can be calibrated so that the medial arm that extends farther under a big toe of a wearer's foot when it is disposed in the footwear 310 including the sole assembly 320. In turn, this can provide the footwear with more spring upon toe off, yet still allow the lateral and medial metatarsals of the wearer's foot to move slightly more independently of one another, rather than being guided by a rigid plate across the entire width of the foot in the forefoot. The lateral arms and medial arm can cantilever forward of the slot base 360SB independently from one another, allowing this flexibility across the width of the foot. This can allow the metatarsals to move more independently of one another, yet still provide spring energy return and assist in roll upon toe off.

As can be seen with further reference to FIGS. 16 and 17, the lateral arm 365 can extend forwardly to a lateral arm tip 365T while the medial arm 366 can extend forwardly to a medial arm tip 366T. Optionally, each of these arm tips can be rounded. The lateral arm tip 365T can include a first edge 365E, while the medial arm tip 366T can include a second edge 366E, the first edge 365E of the lateral arm can have a first radius of curvature R5 as that edge transitions toward the slot 360S and toward the tip 365T. The second edge 366E of the medial arm can have a second radius of curvature R6 as that edge transitions toward the slot 360S and toward the tip 366T. The first radius of curvature and second radius of curvature can be unequal and/or different. In some cases, the first radius of curvature can be greater than the second radius of curvature, while in other applications, the first radius of curvature can be less than the second radius of curvature.

Further optionally, in some applications, the medial arm tip 366T can be narrower than the lateral arm tip. For example as shown in FIG. 16, at a distance of about 5 mm to 10 mm rearward from the forward most portion of the lateral arm tip 365T, the tip and/or arm can include a width N1. This width N1 can be greater than the width N2 rearward from the forward most portion of the tip 366T of the lateral arm 366. Of course in other applications, the widths can be reversed.

With reference to FIG. 16, as mentioned above, the plate slot 360S can be located in its entirety forward of the lowermost portion 360L of the plate, without extending rearward of that portion 360L. The slot base 360B also can be disposed a distance D10, which can be optionally at least 5 mm, at least 10 mm, at least 20 mm or more, forward of the lowermost portion 360L of the plate. In some applications, the outsole 350 optionally can define a slot 350S that is aligned with and overlaps the plate slot 360S. This outsole slot 350S can extend rearward of the lowermost portion 360L of the plate. In some applications, it can extend a distance D11 rearward of the lowermost portion 360L of the plate 360. The outsole slot 350S can divide the outsole into a lateral part 355 and a medial part 356. These lateral and medial parts can extend adjacent the outsole slot 350, and can be aligned with the respective lateral and medial arms of the plate, lying under them. The lateral part and medial part of the outsole forward of the outsole slot however can be joined via a forward connection 357. Further, the medial part and lateral part can be joined rearward of the outsole slot 350S via a rearward connection 358.

Further optionally, the outsole 350 can define a secondary slot 350N located in the arch region and/or the heel region of the sole. This secondary slot 350N, however, might not overlap with any portion of the plate slot 360S. The secondary slot can be rearward of the rearward connection 358 and of the slot 350S that can extend through the arch region and forefoot region of the sole assembly.

Figure 18:
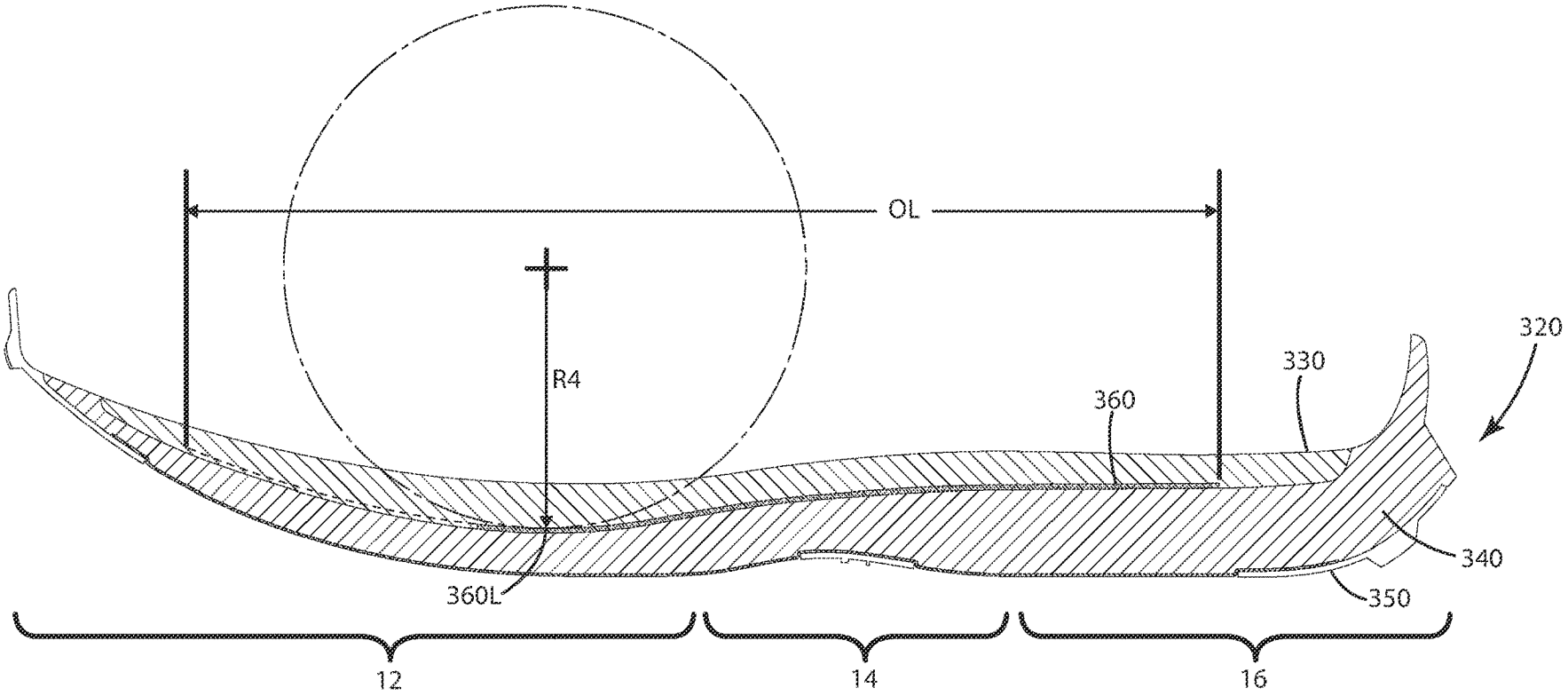
FIG. 18 is a section view thereof, taken along line XVIII-XVIII of FIG. 16.

In this embodiment, the spring plate 360 of the sole assembly 320 shown in FIGS. 16 and 18, as mentioned above, can include a lowermost portion 360L in the forefoot region 12 corresponding to a metatarsal phalangeal joint of a wearer's foot. Forward of this lowermost portion, the plate can include a variety of changing radii of curvature, similar to those described in connection with the embodiments above. As shown in FIG. 16, the plate can include a curvature at that lowermost portion. That curvature can be defined by a radius R4 that emanates from a center of a circle above the plate 360 and extends to and/or or passes through the lowermost portion 360L of the spring plate 360. The spring plate 360 can include an overall length OL. The tread radius R4 can be optionally between 35% and 45% inclusive, between 37% and 42%, inclusive, between 37% and 40%, inclusive, between 39% and 40%, inclusive, or about 39.4% of the overall length OL. It is been discovered that with this relationship between the radius R4 and the overall length, the plate can provide exceptional energy return and assistance in toe off across multiple sizes of footwear including different overall length plates. Accordingly, this relationship of the radius and the overall length need not be recalculated and redesigned for various different sized footwear and associated spring plates. Other dimensions and portions of the plates can be easily scaled up or down relative to one size, while that relationship of the radius R4 to the overall length OL remains the same for different sized footwear using the same type of spring plate.

In this embodiment, the sole assembly 320 can be constructed with the spring plate 360 with one or more of the features described above. Optionally, that spring plate also can be constructed to include certain anisotropic and anti-puncture properties to provide protection, support, and stability to the foot of a wearer of the footwear while still allowing for flexibility. The spring plate can be formed from a layered arrangement having a high resistance to bending in a first direction and a low resistance to bending in an opposing second direction. Put another way, the plate can have a first bending stiffness during bending in a first direction and a second bending stiffness, greater than the first bending stiffness, during bending in a second direction. Exemplary anisotropic configurations for a plate suitable for use herein are disclosed in U.S. Pat. No. 11,109,639 to Shanker, U.S. Pat. No. 10,786,973 to Simmons and U.S. Pat. No. 9,370,904 to Khan, all of which are incorporated by reference in their entirety herein.

Figure 20:
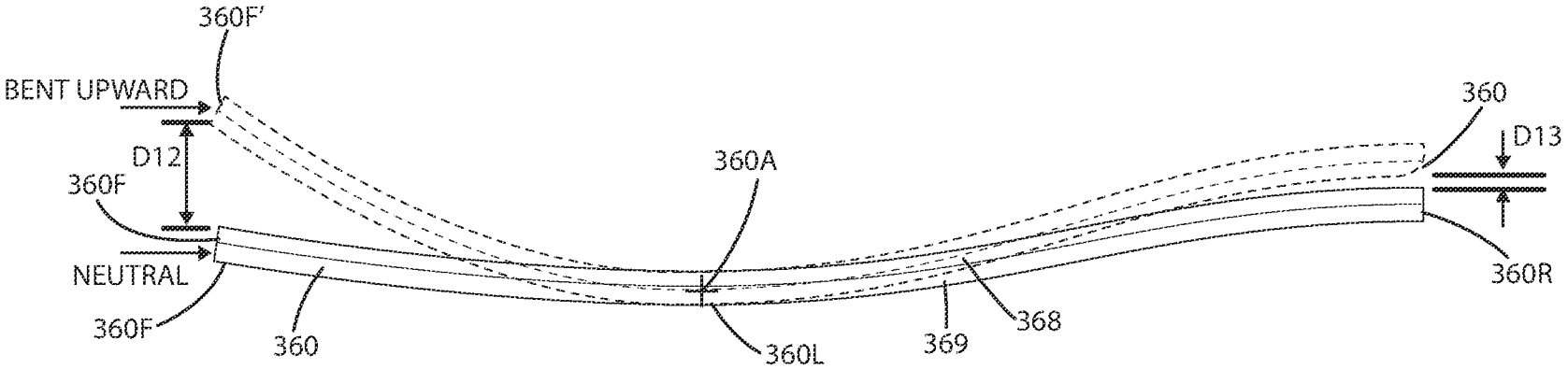
FIG. 20 is a side view of the plate being bent upwardly.
Figure 21:
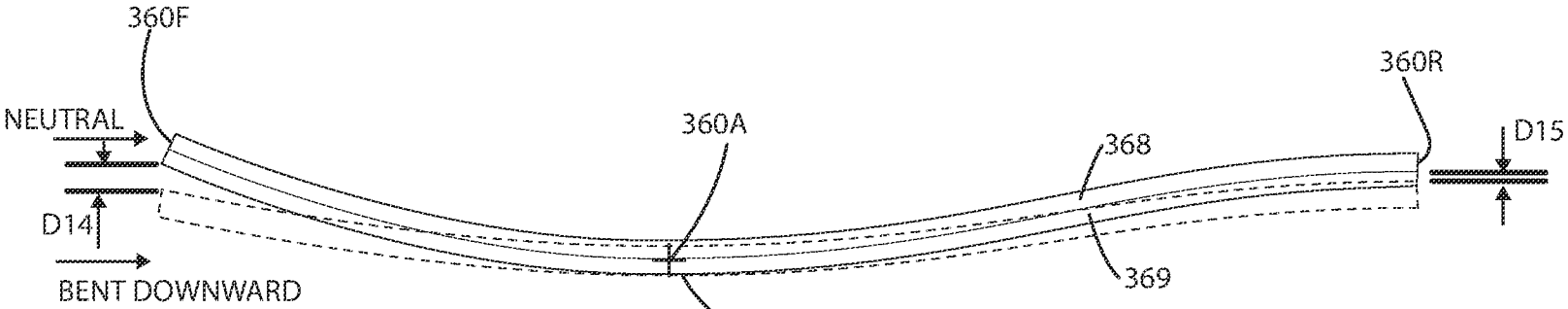
FIG. 21 is a side view of the plate being bent downwardly.

As shown in FIGS. 20 and 21, the plate 360 optionally can be constructed from a first layer 368 and a second layer 369, which can be joined together along an interface between those two layers. As shown in solid lines in both FIGS. 20 and 21, the spring plate 360 is shown in a relaxed or neutral position, neither bent upwardly or downwardly. As shown in broken lines in FIG. 20, the spring plate can be bent away from the relaxed or neutral position or configuration in a first direction, for example, upwardly, about a lateral axis 360A that can extend through the plate above the lowermost portion 360L of the plate. As this occurs, the forwardmost portion 360F and rear most portion 360R of the plate can move upward, for example, distances D12 and D13 from the neutral position of those portions respectively. These distances can correspond to the amount of force transferred from a wearer's foot through the sole assembly to the plate. The plate can have less stiffness and/or relatively low bending resistance to bending forces that cause the plate 360 to bend in this first direction, that is, upwardly, where the plate 360 appears to become more concave upward or more bowed upward when viewed from a side view. This bending in a first direction, for example, upwardly can be experienced by the plate during a normal gait cycle of a wearer, for example during a forward roll of the foot and/or toe off during the gait cycle.

As shown in broken lines in FIG. 21, the spring plate 360 also can be bent away from the relaxed or neutral position or configuration in a second direction, for example downwardly, about the lateral axis 360A. As this occurs, the forward most portion 360F and rear most portion 360R of the plate 360 can move downward, for example distances D14 and D15 from the neutral position or configuration of those portions, respectively. These respective distances D14 and D15 can be less than the respective distances D12 and D13 when the plate is bent in the opposite direction shown in FIG. 20. The plate can have more stiffness and/or relatively higher bending resistance to bending forces that cause the plate 360 to bend in the second direction, that is downwardly, where the plate 360 appears to become more convex upward or less concave, or more bowed downward when viewed from a side view. This bending in a second direction, for example downwardly, can be experienced by the plate when the footwear and sole assembly encounters terrain or an underfoot object closer to the longitudinal center of the plate, rather than at the ends. In turn, this can prevent the underfoot object or terrain from being felt substantially by the wearer and can prevent the foot from conforming to the underfoot terrain causing discomfort or instability. Generally, the plate can be tuned to be flexible and easily bendable in the first direction, but being rigid and inflexible to bending in the opposite direction. Of course, the flexibility and bendability shown in FIGS. 20 and 21 can be reversed, so that the plate can have less bending resistance downward and more bending resistance upward.

Optionally, the first layer 368 can control bending characteristics of the assembly plate 360 in a selected direction, for example, downward as shown in FIG. 21. To do so, the first layer 368 can be made of a material having a tensile modulus that is substantially greater than the material's compressive modulus. A material's modulus (tensile or compressive modulus) can refer to the modulus of elasticity of the material in tension and/or compression. The first layer 368 can be a fiber-reinforced composite material having unidirectional fibers or interlaced fiber encapsulated and/or impregnated in a selected flexible matrix configured so the composite material alone is flexible and pliable or non-rigid. The fibers can be inorganic fibers, such as carbon fibers, glass fibers, ceramic fibers, metal fibers, other fibers, and/or combinations thereof, organic or synthetic fibers, such as polyamide fibers, polyester fibers, or combinations thereof, natural fibers, and/or combinations thereof. The material of the first layer can be such that the spring plate 260 can exhibit strain stiffening behavior. Accordingly, the rate of stiffening in the material can increase in response to increased strain. This configuration can provide the plate and thus the sole assembly with asymmetric flexural characteristics.

Further optionally, the plate 360 can be constructed as a laminate by combining a carbon fiber epoxy plate that defines the second layer 369 with a fiber reinforced nitrile butadiene rubber and thermoplastic polyurethane film that defines the first layer 368. The layers can be joined with adhesives or other bonding materials. In another application, the first layer 368 can be constructed from a nitrile butadiene rubber impregnation with thermoplastic polyurethane films. The second layer 369 can be constructed from material that has a tensile modulus substantially the same as its compressive modulus, for example a rigid carbon fiber epoxy plate, or other materials, including but not limited to steel, titanium, aluminum, other metal material, polycarbonate, polyamide, polyurethane, low density polyurethane, nitrile rubber, butyl rubber, and combinations thereof. Yet further optionally, the compressive modulus of the material used in the second layer 369 can be greater than the compressive modulus of the material used in the first layer 368 to allow the spring plate 360 to be anisotropically-flexible with the anisotropic properties in compression and tension.

The following additional statements about other current embodiments are provided, the lettering of which is not to be construed as designating levels of importance.

Statement A. A footwear is provided comprising an upper; a first midsole platform joined with the upper; a second midsole plate below the first midsole platform; a plate disposed between the first midsole platform and the second midsole platform in a heel region of the footwear, the plate extending through a forefoot region of the footwear and located below the first midsole platform in the forefoot region; and an outsole layer disposed below the plate and the first midsole platform in the forefoot region.

Statement B. The footwear of statement A, wherein the plate defines an aperture extending through the plate in the forefoot region, wherein a mounting cap is joined with the plate and extends through the aperture.

Statement C. The footwear of any preceding statement, wherein the mounting cap includes a mounting flange that extends radially outward from a longitudinal axis of the mounting cap adjacent the aperture.

Statement D. The footwear of any preceding statement, wherein the mounting cap defines a threaded bore configured to receive a spike.

Statement E. The footwear of any preceding statement, wherein the aperture includes a threaded bore extending at least one of through, below and above a lower surface of the plate.

Statement F. The footwear of any preceding statement, wherein the mounting flange is directly adhered to at least one of an upper surface and a lower surface of the plate, the plate being a carbon plate.

Statement G. The footwear of any preceding statement, wherein the outsole layer defines a hole aligned with the aperture in the plate, wherein a threaded shaft of a spike extends through the hole and into the aperture.

Statement H. The footwear of any preceding statement, wherein the mounting cap includes a metal threaded portion, wherein the threaded portion is configured to engage the spike, wherein the threaded portion extends through the plate aperture, or wherein the threaded portion extends below the lower surface of the plate, without extending through the plate aperture.

Statement I. The footwear of any preceding statement, wherein the plate defines a first radius of curvature and a second radius of curvature in the forefoot region, wherein a first aperture is located in the first radius and wherein a second aperture is located in the second radius, distal from the first aperture.

Statement J. The footwear of any preceding statement, wherein the mounting flange is engaged with the second midsole platform above an upper surface of the plate.

Statement K. The footwear of any preceding statement, wherein the mounting cap includes a barrel, wherein the barrel extends through the aperture defined by the plate from an upper surface to a lower surface of the plate, and through a hole defined by an outsole layer disposed directly below the lower surface, such that the barrel extends at least partially through the outsole layer.

Statement L. The footwear of any preceding statement, wherein the barrel defines a threaded bore configured to receive threads of a stud of a traction spike, wherein the threaded bore is in the form of a metal insert, wherein the threaded insert extends at least one of above and below at least one of the upper surface and lower surface of the plate, and optionally completely through the plate.

Statement M. The footwear of any preceding statement, wherein the mounting cap includes a tooth, wherein the tooth engages the plate adjacent the aperture to prevent rotation of the mounting cap relative to the plate when a spike is rotated relative to a threaded bore of the mounting cap.

Statement N. The footwear of any preceding statement, wherein the tooth extends at least partially through or into the plate.

Statement O. The footwear of any preceding statement, wherein the tooth is in the form of a plurality of barbs that engage in the upper surface of the plate to prevent it from spinning upon a rotation force being transmitted to the mounting cap.

Statement P: The footwear of any preceding statement wherein the plate is a carbon plate comprising a plurality of layers of strands of carbon, wherein each of the layers includes a respective layer edge adjacent the plate aperture, wherein the plate aperture extends through the plurality of layers, wherein a barrel of the mounting cap is disposed adjacent a plurality of the respective layer edges when the mounting cap is joined with the plate.

Statement Q: The footwear of any preceding statement, wherein the mounting flange of the mounting cap is disposed below the lower surface of the plate, wherein the threaded bore does not extend through the aperture or the plate.

Statement R: The footwear of any preceding statement, wherein the plate includes no voids rearward of the arch region that are surrounded by the material of the plate.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A footwear construction comprising:

a first midsole including a first midsole upper surface configured to face a wearer's foot, and a first midsole lower surface opposing and below the first midsole upper surface, the first midsole extending in a heel region, an arch region and a forefoot region of the footwear, with a first midsole sidewall extending from the first midsole lower surface to the first midsole upper surface;

a plate disposed adjacent and below the first midsole, the plate including a heel portion in the heel region, an arch portion in the arch region and a forefoot portion in the forefoot region, the plate including a lowermost portion configured to be disposed under the ball of a wearer's foot, the plate extending upward and forward from the lowermost portion, with the plate being of a plurality of radii of curvature in a transition portion from the lowermost portion to a forward most portion of the plate, the plate including a lateral arm and a medial arm in the forefoot region separated by a plate slot extending rearward from the forwardmost portion of the plate toward the lowermost portion, the plate slot having a rounded base near the lowermost portion, the medial arm extending forward a first distance from the base, the lateral arm extending forward a second distance from the base, the first distance greater than the second distance, the plate having a first bending stiffness during bending in a first direction and a second bending stiffness greater than the first bending stiffness during bending in a second direction;

a second midsole disposed below the plate and the first midsole, the second midsole bounded at least partially by a first upstanding midsole wall extending around a perimeter of the first midsole and approximating a shape of a wearer's foot in the heel region and the arch region, the first upstanding midsole wall extending above the plate in the heel region and the arch region, the second midsole including a second midsole lower surface and an opposing second midsole upper surface, the second midsole extending through the heel region, the arch region and the forefoot region, the second midsole defining a second midsole recess bounded by a second midsole sidewall, the first midsole and plate disposed at least partially in the second midsole recess so that the first midsole sidewall and the second midsole sidewall are adjacent one another; and an outsole layer including an outsole upper surface and an outsole lower surface, the outsole upper surface being joined with and engaging the second midsole lower surface; and an upper joined above the first midsole, wherein the first midsole lower surface defines a first midsole lower recess, wherein the plate is disposed in the first midsole lower recess, wherein the first midsole is configured to provide underfoot cushion.

2. The footwear construction of claim 1, wherein the plate includes an upper layer and a lower layer, wherein the plate is elastically bendable about an axis in the first direction that puts the lower layer in tension and the upper layer in compression, wherein the plate is elastically bendable about the axis in the second direction opposite the first direction that puts the lower layer in compression and the upper layer in tension.

3. The footwear construction of claim 1, wherein the outsole comprises an outsole slot aligned with the plate slot, wherein the outsole includes a medial part and a lateral part that extend adjacent the outsole slot, wherein the medial part is joined with the lateral part forward of the outsole slot via a forward connection, wherein the medial part is joined with the lateral part rearward of the outsole slot via a rearward connection.

4. The footwear construction of claim 1, wherein the first upstanding midsole wall extends above the first midsole upper surface in the heel region and the arch region.

5. The footwear construction of claim 1, wherein the plate is adhered to the second midsole upper surface, wherein the first midsole lower surface is adhered to the second midsole upper surface with an adhesive.

6. The footwear construction of claim 5, wherein the first midsole sidewall is adhered to the second midsole sidewall with the adhesive.

7. The footwear construction of claim 1, wherein the lateral arm includes a lateral arm tip, wherein the medial arm includes a medial arm tip, wherein the lateral arm has a first edge with a first radius of curvature transitioning to the lateral arm tip, wherein the medial arm tip has a second edge with a second radius of curvature transitioning to the medial arm tip, wherein the first radius of curvature and the second radius of curvature are different.

8. The footwear construction of claim 1, wherein the lateral arm terminates at a lateral arm tip that is rounded;

wherein the medial arm terminates at a medial arm tip that is rounded, wherein the medial arm tip is narrower than the lateral arm tip.

9. A footwear construction comprising:

a first midsole including a first midsole upper surface configured to face a wearer's foot, and a first midsole lower surface opposing and below the first midsole upper surface, the first midsole extending in a heel region, an arch region and a forefoot region of the footwear, with a first midsole sidewall extending from the first midsole lower surface to the first midsole upper surface;

a plate disposed adjacent and below the first midsole, the plate including a heel portion in the heel region, an arch portion in the arch region and a forefoot portion in the forefoot region, the plate including a lowermost portion configured to be disposed under the ball of a wearer's foot, the plate extending upward and forward from the lowermost portion, with the plate being of a plurality of radii of curvature in a transition portion from the lowermost portion to a forward most portion of the plate, the plate including a lateral arm and a medial arm in the forefoot region separated by a plate slot extending rearward from the forwardmost portion of the plate toward the lowermost portion, the plate slot having a rounded base near the lowermost portion, the medial arm extending forward a first distance from the base, the lateral arm extending forward a second distance from the base, the first distance greater than the second distance, the plate having a first bending stiffness during bending in a first direction and a second bending stiffness greater than the first bending stiffness during bending in a second direction;

a second midsole disposed below the plate and the first midsole, the second midsole bounded at least partially by a first upstanding midsole wall extending around a perimeter of the first midsole and approximating a shape of a wearer's foot in the heel region and the arch region, the first upstanding midsole wall extending above the plate in the heel region and the arch region, the second midsole including a second midsole lower surface and an opposing second midsole upper surface, the second midsole extending through the heel region, the arch region and the forefoot region, the second midsole defining a second midsole recess bounded by a second midsole sidewall, the first midsole and plate disposed at least partially in the second midsole recess so that the first midsole sidewall and the second midsole sidewall are adjacent one another; and an outsole layer including an outsole upper surface and an outsole lower surface, the outsole upper surface being joined with and engaging the second midsole lower surface; and an upper joined above the first midsole, wherein the first midsole lower surface defines a first midsole lower recess, wherein the plate is disposed in the first midsole lower recess, wherein the plate includes a plate lower surface, wherein the plate lower surface is flush with the first midsole lower surface when the plate is in the first midsole lower recess.

10. A footwear construction comprising:

a first midsole including a first midsole upper surface configured to face a wearer's foot, and a first midsole lower surface opposing and below the first midsole upper surface, the first midsole extending in a heel region, an arch region and a forefoot region of the footwear, with a first midsole sidewall extending from the first midsole lower surface to the first midsole upper surface;

a plate disposed adjacent and below the first midsole, the plate including a heel portion in the heel region, an arch portion in the arch region and a forefoot portion in the forefoot region, the plate including a lowermost portion configured to be disposed under the ball of a wearer's foot, the plate extending upward and forward from the lowermost portion, with the plate being of a plurality of radii of curvature in a transition portion from the lowermost portion to a forward most portion of the plate, the plate including a lateral arm and a medial arm in the forefoot region separated by a plate slot extending rearward from the forwardmost portion of the plate toward the lowermost portion, the plate slot having a rounded base near the lowermost portion, the medial arm extending forward a first distance from the base, the lateral arm extending forward a second distance from the base, the first distance greater than the second distance, the plate having a first bending stiffness during bending in a first direction and a second bending stiffness greater than the first bending stiffness during bending in a second direction;

a second midsole disposed below the plate and the first midsole, the second midsole bounded at least partially by a first upstanding midsole wall extending around a perimeter of the first midsole and approximating a shape of a wearer's foot in the heel region and the arch region, the first upstanding midsole wall extending above the plate in the heel region and the arch region, the second midsole including a second midsole lower surface and an opposing second midsole upper surface, the second midsole extending through the heel region, the arch region and the forefoot region, the second midsole defining a second midsole recess bounded by a second midsole sidewall, the first midsole and plate disposed at least partially in the second midsole recess so that the first midsole sidewall and the second midsole sidewall are adjacent one another;

an outsole layer including an outsole upper surface and an outsole lower surface, the outsole upper surface being joined with and engaging the second midsole lower surface; and an upper joined above the first midsole, wherein the first midsole includes a first ridge, wherein the first ridge extends within the plate slot between the medial arm and the lateral arm.

* * * * *